US008146652B2

(12) United States Patent
Higashiyama et al.

(10) Patent No.: US 8,146,652 B2
(45) Date of Patent: Apr. 3, 2012

(54) HEAT EXCHANGER

(75) Inventors: Naohisa Higashiyama, Oyama (JP); Yukihiro Tsurumi, Oyama (JP)

(73) Assignee: Showa Denko K. K., Tokyo (JP)

( * ) Notice: Subject to any disclaimer, the term of this patent is extended or adjusted under 35 U.S.C. 154(b) by 1048 days.

(21) Appl. No.: 12/045,288

(22) Filed: Mar. 10, 2008

(65) Prior Publication Data

US 2008/0223566 A1 Sep. 18, 2008

(30) Foreign Application Priority Data

Mar. 16, 2007 (JP) ..... 2007-068478

(51) Int. Cl.
*F28D 7/16* (2006.01)

(52) U.S. Cl. ..... 165/176; 165/174

(58) Field of Classification Search ..... 165/174, 165/176

See application file for complete search history.

(56) References Cited

U.S. PATENT DOCUMENTS

| | | | | |
|---|---|---|---|---|
| 7,490,661 | B2 * | 2/2009 | Nishino et al. | 165/174 |
| 2004/0159121 | A1 * | 8/2004 | Horiuchi et al. | 165/153 |
| 2005/0126770 | A1 * | 6/2005 | Higashiyama | 165/174 |

FOREIGN PATENT DOCUMENTS

| | | |
|---|---|---|
| JP | 2006-132920 | 5/2006 |
| JP | 2006-183994 | 7/2006 |

OTHER PUBLICATIONS

Office Action issued on Sep. 27, 2011 in the corresponding Japanese Patent Application No. 2007-068478 (with an English translation of its rough abstract).

* cited by examiner

*Primary Examiner* — Teresa Walberg
(74) *Attorney, Agent, or Firm* — Oblon, Spivak, McClelland, Maier & Neustadt, L.L.P.

(57) ABSTRACT

A heat exchanger used as an evaporator is configured such that two heat exchange tube groups, each composed of a plurality of heat exchange tubes, are provided between a pair of header tanks, while being separated from each other in a front-rear direction. Each of the header tanks includes two header sections. Each header tank includes a first member to which the heat exchange tubes are connected, a second member which is joined to the first member and covers the side of the first member opposite the heat exchange tubes, and a partition plate disposed between the first and second members and having partition portions which divide the interiors of the two header sections into respective upper and lower spaces. Through holes are formed in the partition portions so as to establish communication between the upper and lower spaces of the header sections.

12 Claims, 14 Drawing Sheets

HEAT EXCHANGER

BACKGROUND OF THE INVENTION

The present invention relates to a heat exchanger preferably used as an evaporator of a car air conditioner, which is a refrigeration cycle to be mounted on, for example, an automobile.

Herein and in the appended claims, the upper, lower, left-hand, and right-hand sides of FIG. 2 will be referred to as "upper," "lower," "left," and "right," respectively. Also, herein and in the appended claims, the downstream side (a direction represented by arrow X in FIGS. 1 and 3) of an air flow through air-passing clearances between adjacent heat exchange tubes will be referred to as the "front," and the opposite side as the "rear."

The applicant of the present application has proposed an improved heat exchanger as an evaporator for a car air conditioner which satisfies the needs of reducing size and weight and enhancing performance (see Japanese Patent Application Laid-Open (kokai) No. 2006-183994). In the improved heat exchanger, a plurality of heat exchange tube groups are arranged in a front-rear direction between upper and lower header tanks separated from each other in a vertical direction. Each heat exchange tube group consists of a plurality of heat exchange tubes which are arranged at predetermined intervals along the longitudinal direction of the header tanks and whose opposite end portions are connected to the corresponding header tanks. Each of the header tanks includes two header sections arranged in the front-rear direction and integrated together. Each of header tanks is composed of a first member which is formed of an aluminum brazing sheet and to which all the heat exchange tubes are connected; and a second member which is formed of an aluminum extrudate and which is joined to the first member so as to cover the side of the first member opposite the heat exchange tubes. A single heat exchange tube group is provided between each header section of the upper header tank and the corresponding header section of the lower header tank. The front header section of the upper header tank serves as a refrigerant inlet header section; the rear header section of the upper header tank serves as a refrigerant outlet header section; the front header section of the lower header tank serves as a first intermediate header section; and the rear header section of the lower header tank serves as a second intermediate header section. A refrigerant inlet is formed in one end portion of the refrigerant inlet header section, and a refrigerant outlet is formed in an end portion of the refrigerant outlet header section located on the same side as the end portion of the refrigerant inlet header section. The interiors of the refrigerant inlet header section, the refrigerant outlet header section, and the second intermediate header section are each divided into upper and lower spaces by means of a partition plate formed integrally with the corresponding second member. The upper and lower spaces within the refrigerant inlet header section communicate with each other via a communication hole formed in the partition plate at an end portion opposite the refrigerant inlet and the refrigerant outlet, as well as via a plurality of refrigerant-passage through holes formed in the partition plate at intervals in the longitudinal direction. The upper and lower spaces of the refrigerant outlet header section communicate with each other via refrigerant-passage through holes formed in the corresponding partition plate. Similarly, the upper and lower spaces of the second intermediate header section communicate with each other via refrigerant-passage through holes formed in the corresponding partition plate. Further, the space within the first intermediate header section and the lower space within the second intermediate header section communicate with each other via a communication portion provided in one end portion of the lower header tank with respect to the longitudinal direction thereof.

Incidentally, in order to improve the heat exchange performance of the heat exchanger described in the publication, the divided flow of refrigerant to all the heat exchange tubes must be controlled such that discharged-air temperature, or the temperature of air having passed through the heat exchanger, becomes uniform among different portions of the heat exchanger. In order to control the divided flow of refrigerant to all the heat exchange tubes, it is necessary to properly control the flow of refrigerant from the upper space to the lower space within the refrigerant inlet header section, the flow of refrigerant from the lower space within the refrigerant inlet header section to all the heat exchange tubes of the front heat exchange tube group, and the flow of refrigerant from the upper space within the second intermediate header section to all the heat exchange tubes of the rear heat exchange tube group. Such flow control can be effectively performed by means of forming the partition plates of the refrigerant inlet header section and the second intermediate header section to have a complicated shape, or forming flanges around the through holes of the partition plates of the refrigerant inlet header section and the second intermediate header section such that the flanges project toward the heat exchange tubes.

However, in the case of the heat exchanger described in the publication, since each second member having an integrally formed partition plate is formed of an aluminum extrudate, the partition plate can be formed only into the shape of a flat plate. In addition, since the through holes are formed by performing press working on the partition plate, it is impossible to form flanges around the through holes such that the flanges project toward the heat exchange tubes. Accordingly, in the case of the heat exchanger described in the publication, separate components must be provided in order to control the divided flow of refrigerant to all the heat exchange tubes such that discharged-air temperature, or the temperature of air having passed through the heat exchanger, becomes uniform among different portions of the heat exchanger. In this case, there arise problems that the number of components increases, and production work becomes troublesome.

SUMMARY OF THE INVENTION

An object of the present invention is to solve the above problem and to provide a heat exchanger which is composed of a reduced number of components and whose production work is easy.

To achieve the above object, the present invention comprises the following modes.

1) A heat exchanger comprising upper and lower header tanks separated from each other in a vertical direction; and a plurality of heat exchange tube groups arranged in a front-rear direction between the header tanks, each heat exchange tube group consisting of a plurality of heat exchange tubes which are arranged at predetermined intervals along a longitudinal direction of the header tanks and whose opposite end portions are connected to the corresponding header tanks, and each of the header tanks including two header sections arranged in the front-rear direction and integrated together, wherein each of header tanks is composed of a first member to which the heat exchange tubes are connected and a second member which is joined to the first member and covers a side of the first member opposite the heat exchange tubes, and at least one heat exchange tube group is provided between each header section of the upper header tank and the corresponding header section of the lower header tank, wherein the first and second members of each header tank are joined via a partition plate which divides the two header sections into respective upper and lower spaces; and the partition plate includes through holes for establishing communication between the upper and lower spaces of each header section.

2) A heat exchanger according to par. 1), wherein a plurality of through holes are formed in a portion of the partition plate present within a header section in which refrigerant flows into the heat exchange tubes.

3) A heat exchanger according to par. 2), wherein flanges are integrally formed on a surface of the partition plate facing the heat exchange tubes such that the flanges project toward the heat exchange tubes from circumferential edges of the corresponding through holes so as to completely surround the corresponding through holes.

4) A heat exchanger according to par. 2), wherein guide portions for guiding refrigerant toward the heat exchange tubes from the space opposite the heat exchange tubes are integrally formed on one surface of the partition plate such that the guide portions project from circumferential edges of the corresponding through holes.

5) A heat exchanger according to par. 4), wherein the guide portions are integrally formed on a surface of the partition plate facing the heat exchange tubes such that the guide portions project from portions of circumferential edges of the corresponding through holes, the portions being located on the upstream sides of the through holes with respect to a flow direction of refrigerant within a space, opposite the heat exchange tubes, of the header section in which refrigerant flows into the heat exchange tubes.

6) A heat exchanger according to par. 2), wherein each of the through holes is formed between adjacent heat exchange tubes.

7) A heat exchanger according to par. 1), wherein a plurality of bulging portions are formed on a portion of the partition plate present within a header section in which refrigerant flows into the heat exchange tubes such that the bulging portions project toward the heat exchange tubes and each have a flat projecting end wall; and at least one bulging portion includes a through hole formed in the projecting end wall.

8) A heat exchanger according to par. 7), wherein each of the bulging portions is formed between adjacent heat exchange tubes.

9) A heat exchanger according to par. 1), wherein hemispherical bulging portions are formed on a portion of the partition plate present within a header section in which refrigerant flows into the heat exchange tubes such that the bulging portions project toward the heat exchange tubes; and at least one bulging portion includes a plurality of through holes formed therein.

10) A heat exchanger according to par. 1), wherein a plurality of projecting portions each having a V-shaped transverse cross section are formed on a portion of the partition plate present within a header section in which refrigerant flows into the heat exchange tubes such that the projecting portions project toward the heat exchange tubes and extend in a width direction of the header tank; and a through hole is formed in at least one projecting portion such that the through hole extends over opposite wall portions of the projecting portion, which wall portions form the V shape.

11) A heat exchanger according to par. 1), wherein a plurality of projecting portions each having a V-shaped transverse cross section are formed on a portion of the partition plate present within a header section in which refrigerant flows into the heat exchange tubes such that the projecting portions project toward the heat exchange tubes and extend in a width direction of the header tank; and a through hole is formed in each of opposite wall portions of at least one projecting portion, which wall portions form the V shape.

12) A heat exchanger according to par. 1), wherein the partition plate has grooves formed along opposite side edges portions of the partition plate such that the grooves extend along the longitudinal direction and are opened toward a direction opposite the heat exchange tubes; and opposite side edge portions of the second member are fitted into the grooves.

13) A heat exchanger according to par. 1), wherein the front header section of one header tank serves as a refrigerant inlet header section, the rear header section of the one header tank serves as a refrigerant outlet header section, the front header section of the other header tank serves as a first intermediate header section, and the rear header section of the other header tank serves as a second intermediate header section; a refrigerant inlet is formed in one end portion of the refrigerant inlet header section, and a refrigerant outlet is formed in one end portion of the refrigerant outlet header section located on the same side as the end portion of the refrigerant inlet header section; and each of the refrigerant inlet header section and the second intermediate header section serves as a header section in which refrigerant flows into the heat exchange tubes.

14) A heat exchanger according to par. 13), wherein a communication hole is formed in an end portion of the partition plate opposite the refrigerant inlet and the refrigerant outlet so as to establish communication between the two spaces of the refrigerant inlet header section; and a communication portion is provided at one longitudinal end of the header tank so as to establish communication between an outer space of the first intermediate header section with respect to the vertical direction and an outer space of the second intermediate header section with respect to the vertical direction.

According to the heat exchanger of par. 1), the first and second members of each header tank are joined via a partition plate which divides the two header sections into respective upper and lower spaces; and the partition plate includes through holes for establishing communication between the upper and lower spaces of each header section. Therefore, the partition plate can be formed into a complicated shape relatively simply through press working performed on a metal plate serving as a raw material. Accordingly, the partition plate can be formed into a shape suitable for controlling the divided flow of refrigerant to all the heat exchange tubes such that discharged-air temperature, or the temperature of air having passed through the heat exchanger, becomes uniform among different portions of the heat exchanger. As a result, provision of separate components becomes unnecessary, the number of components decreases, and production work becomes easier.

According to the heat exchanger of par. 2), a plurality of through holes are formed in a portion of the partition plate present within a header section in which refrigerant flows into the heat exchange tubes. Therefore, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchanger of par. 3), flanges are integrally formed on a surface of the partition plate facing the heat exchange tubes such that the flanges project toward the heat exchange tubes from circumferential edges of the corresponding through holes so as to completely surround the corresponding through holes. Therefore, the above-described effect of the heat exchanger of par. 2) is further enhanced by the action of the flanges.

According to the heat exchangers of pars. 4) and 5), the above-described effect of the heat exchanger of par. 2) is further enhanced by the action of the guide portions.

According to the heat exchanger of par. 5), the guide portions can generate a flow of refrigerant in a direction opposite the flow direction of refrigerant in the heat-exchange-tube-side space of the header section in which refrigerant flows into the heat exchange tubes. Therefore, the divided flow can be made uniform through mixing of refrigerant within the heat-exchange-tube-side space of the header section.

According to the heat exchanger of par. 6), the above-described effect of the heat exchanger of any of pars. 2) to 5) is further enhanced.

According to the heat exchanger of par. 7), a plurality of bulging portions are formed on a portion of the partition plate present within a header section in which refrigerant flows into the heat exchange tubes such that the bulging portions project toward the heat exchange tubes and each have a flat projecting end wall; and at least one bulging portion includes a through hole formed in the projecting end wall. Therefore, by the action of the bulging portions, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchanger of par. 8), the above-described effect of the heat exchanger of par. 7) is further enhanced.

According to the heat exchanger of par. 9), a plurality of hemispherical bulging portions are formed on a portion of the partition plate present within a header section in which refrigerant flows into the heat exchange tubes such that the bulging portions project toward the heat exchange tubes; and at least one bulging portion includes a plurality of through holes formed therein. Therefore, by the action of the bulging portions, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchangers of pars. 10) and 11), a plurality of projecting portions each having a V-shaped transverse cross section are formed on a portion of the partition plate present within a header section in which refrigerant flows into the heat exchange tubes such that the projecting portions project toward the heat exchange tubes and extend in a width direction of the header tank; and a through hole is formed in at least one projecting portion such that it extends over opposite wall portions of the projecting portion, which wall portions form the V shape. Therefore, by the action of the projecting portions, it becomes possible to control the divided flow of refrigerant from the heat-exchange-tube-side space of the header section to all the heat exchange tubes communicating with the header section such that the discharged-air temperature, or the temperature of air having passed through the heat exchanger, becomes uniform among different portions of the heat exchanger.

According to the heat exchanger of pars. 12), the reliability of the joint between the first member and the partition plate can be improved.

DESCRIPTION OF THE PREFERRED EMBODIMENT

Figure 1:
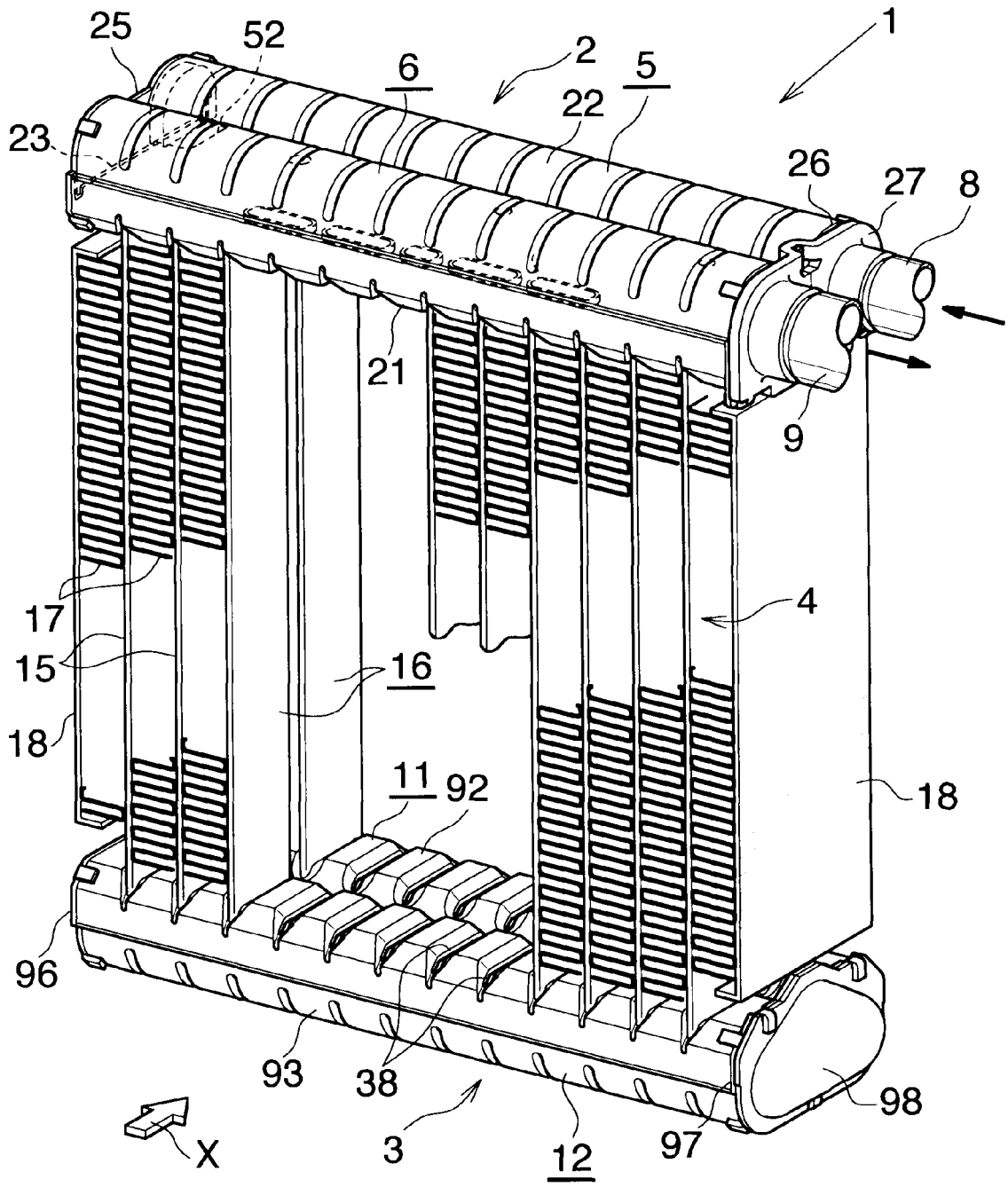
FIG. 1 is a partially cut-away perspective view showing the overall configuration of an evaporator to which a heat exchanger according to the present invention is applied.

An embodiment of the present invention will next be described in detail with reference to the drawings. The embodiment is of a heat exchanger according to the present invention that is applied to an evaporator of a car air conditioner using a chlorofluorocarbon-based refrigerant.

In the following description, the term "aluminum" includes aluminum alloys in addition to pure aluminum.

Further, the same reference numerals are used throughout the drawings to refer to similar parts or elements, and their repeated descriptions are omitted.

Figure 2:
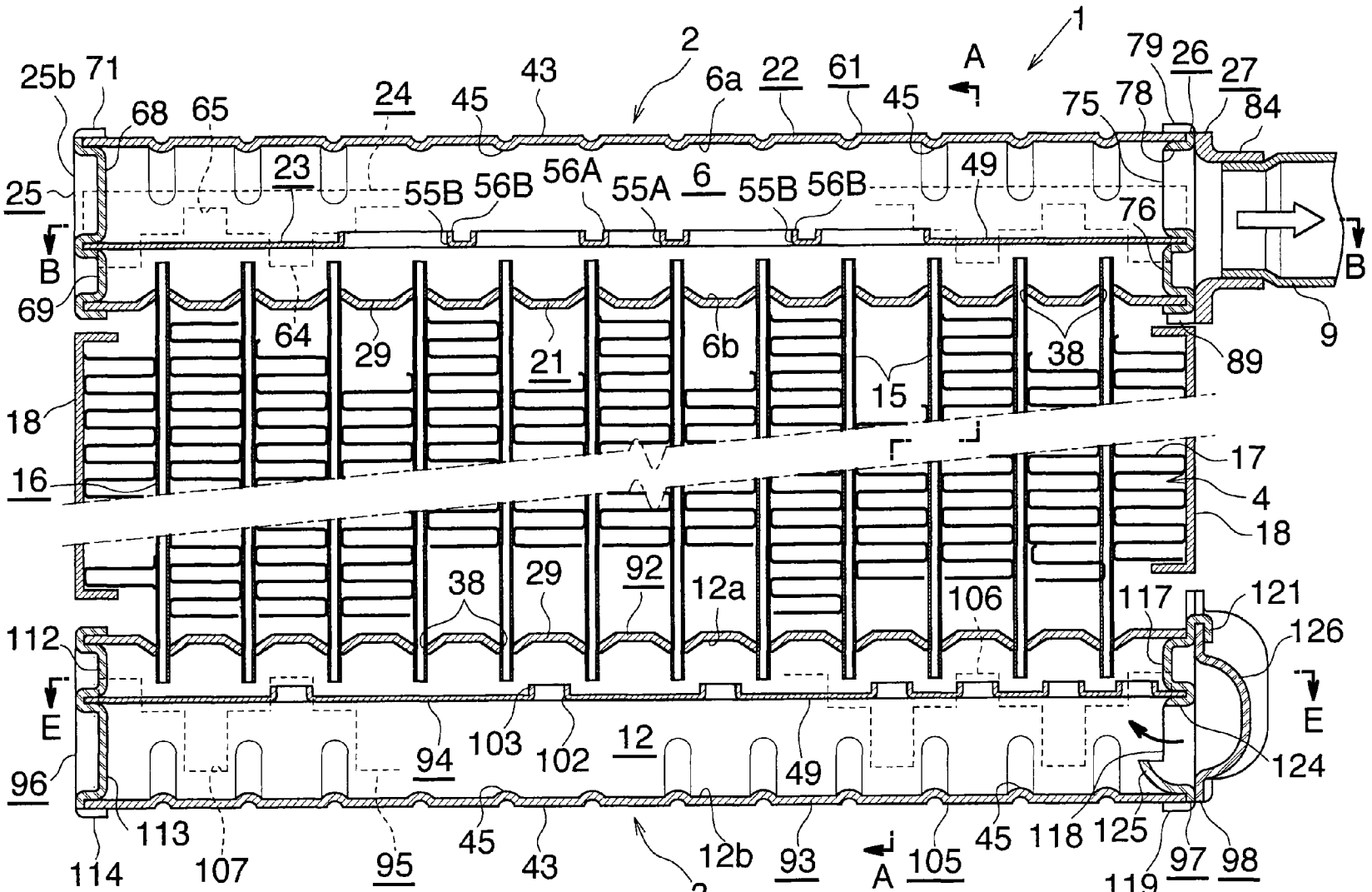
FIG. 2 is a vertical cross sectional view of the evaporator of FIG. 1 as it is seen from the rear, with its intermediate portion omitted.

FIGS. 1 and 2 show the overall configuration of an evaporator, and FIGS. 3 to 9 show the configuration of a main portion of the evaporator.

Figure 3:
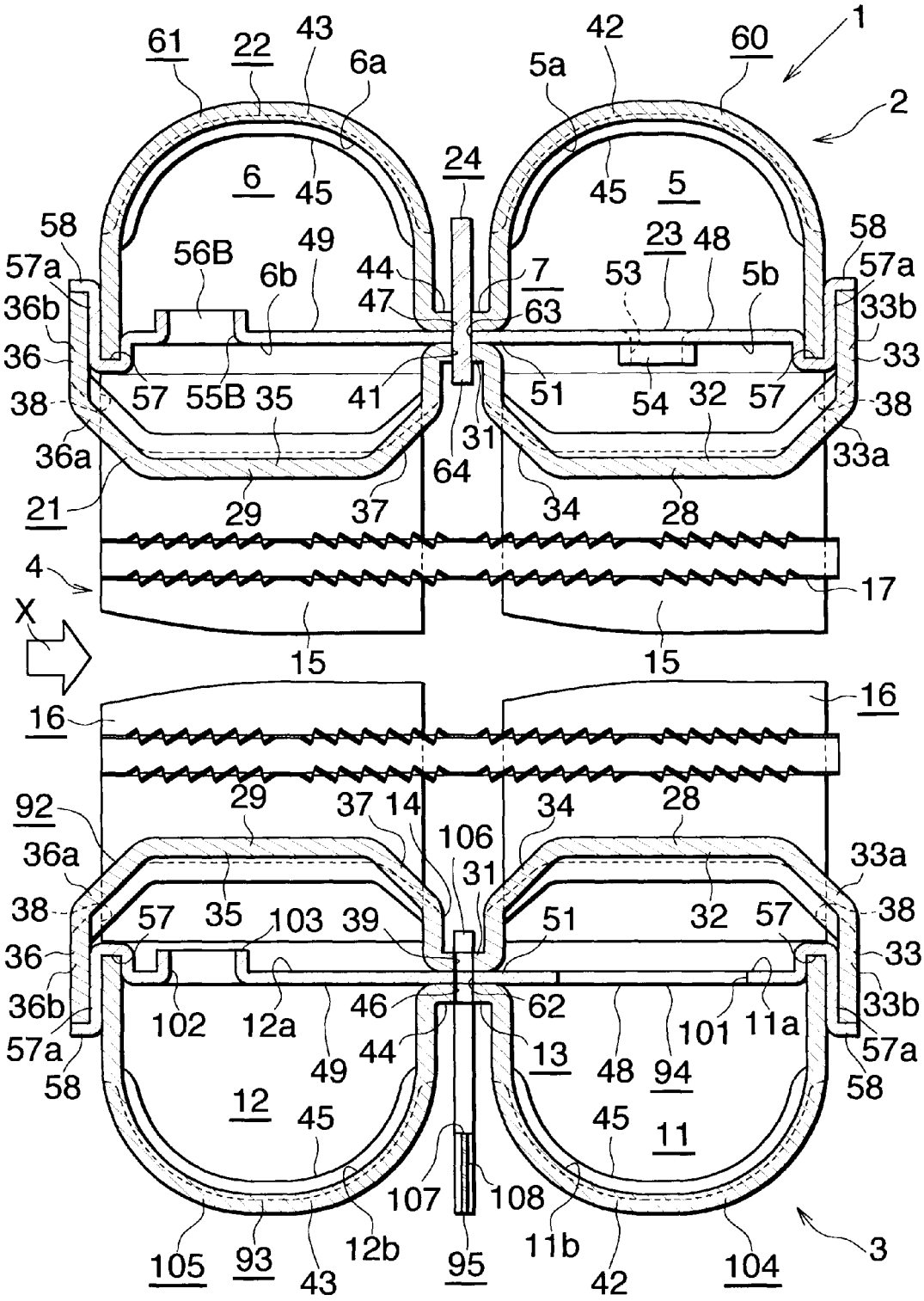
FIG. 3 is a partially-omitted, enlarged cross sectional view taken along line A-A of FIG. 2.
Figure 4:
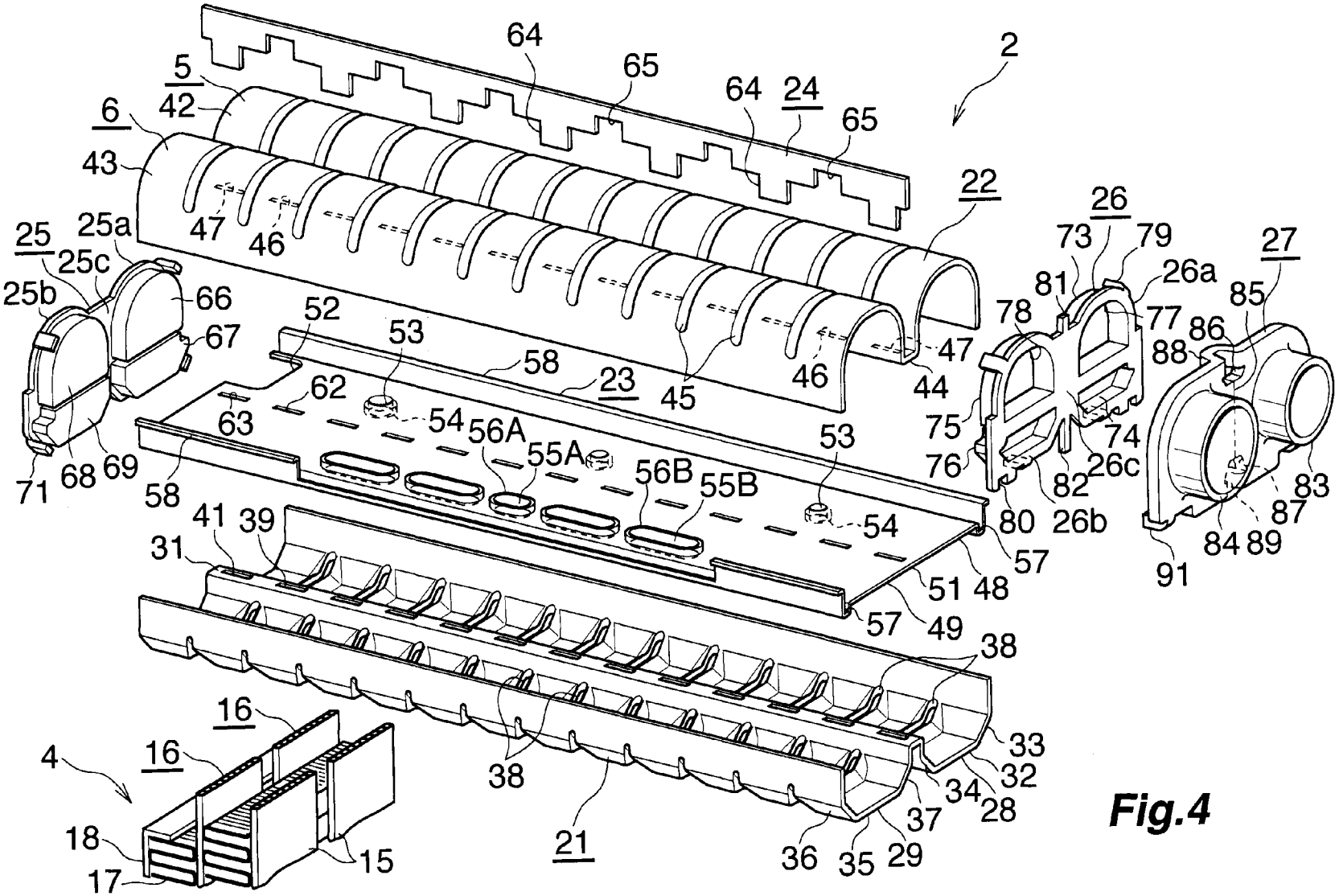
FIG. 4 is an exploded perspective view of a refrigerant inlet/outlet header tank of the evaporator shown in FIG. 1.
Figure 5:
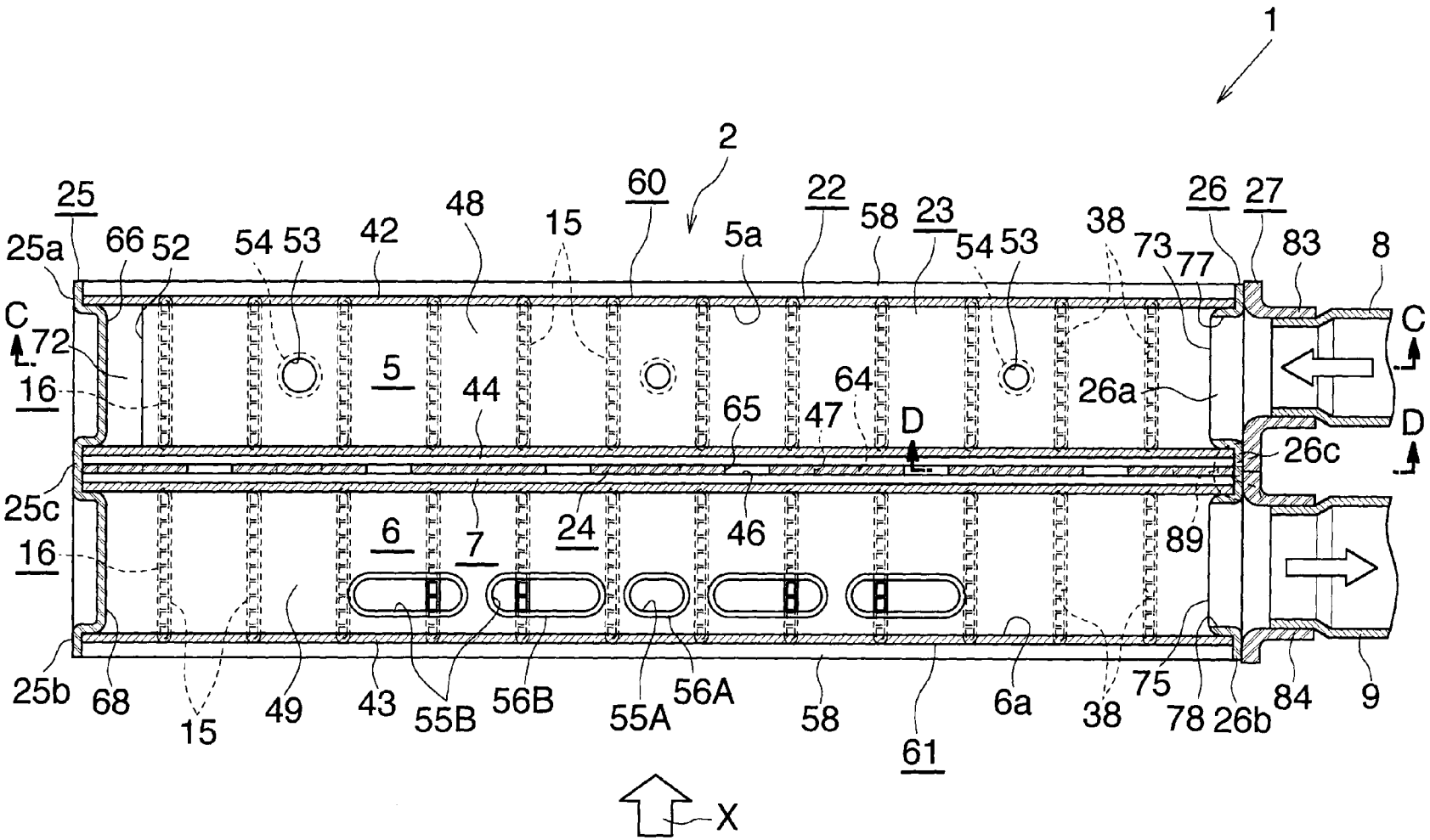
FIG. 5 is a cross sectional view taken along line B-B of FIG. 2.
Figure 6:
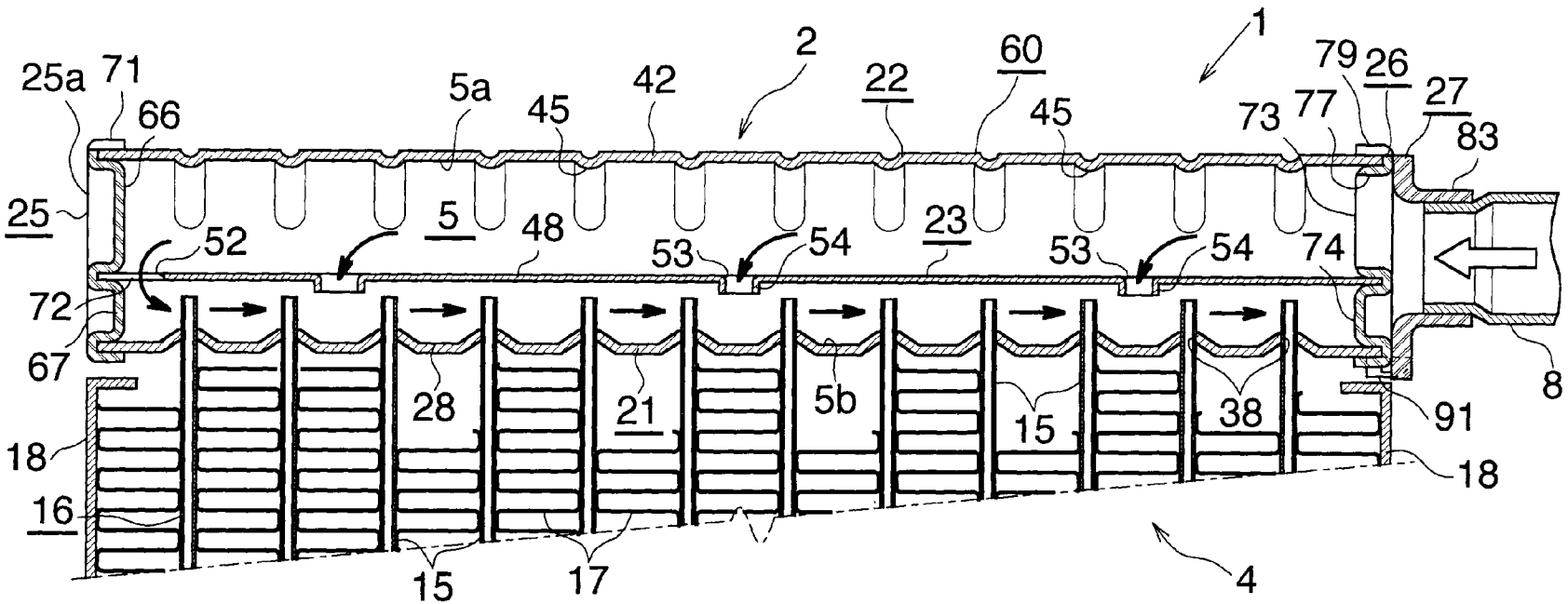
FIG. 6 is a partially-omitted cross sectional view taken along line C-C of FIG. 5.

As shown in FIGS. 1 to 3, the evaporator (1) is configured such that a heat exchange core section (4) is provided between a refrigerant inlet/outlet header tank (2) made of aluminum and a refrigerant turn header tank (3) made of aluminum, which are separated from each other in the vertical direction.

The refrigerant inlet/outlet header tank (2) includes a refrigerant inlet header section (5) located on the front side (downstream side with respect to the air flow direction); a refrigerant outlet header section (6) located on the rear side (upstream side with respect to the air flow direction); and a connection portion (7) for mutually connecting the header sections (5) and (6) for integration (see FIG. 3). A refrigerant inlet pipe (8) made of aluminum is connected to the refrigerant inlet header section (5) of the refrigerant inlet/outlet header tank (2). A refrigerant outlet pipe (9) made of aluminum is connected to the refrigerant outlet header section (6) of the refrigerant inlet/outlet header tank (2).

The refrigerant turn header tank (3) includes a first intermediate header section (11) located on the front side; a second intermediate header section (12) located on the rear side; and a connection portion (13) for mutually connecting the header sections (11) and (12) for integration. The header sections (11) and (12) and the connection portion (13) form a drain trough (14) (see FIG. 3). The circumferential walls of the refrigerant inlet/outlet header tank (2) and the refrigerant turn header tank (3) have transverse cross sectional shapes which are identical with each other but are mirror images with respect to the vertical direction.

The heat exchange core section (4) is configured such that heat exchange tube groups (16) are arranged in a plurality of; herein, two, rows in the front-rear direction, each heat exchange tube group (16) consisting of a plurality of heat exchange tubes (15) arranged in parallel at predetermined intervals in the left-right direction. Corrugate fins (17) are disposed within air-passing clearances between the adjacent heat exchange tubes (15) of the heat exchange tube groups (16) and on the outer sides of the leftmost and rightmost heat exchange tubes (15) of the heat exchange tube groups (16), and are brazed to the corresponding heat exchange tubes (15). Side plates (18) made of aluminum are disposed on the outer sides of the leftmost and rightmost corrugate fins (17), and are brazed to the corresponding corrugate fins (17). The upper and lower ends of the heat exchange tubes (15) of the front heat exchange tube group (16) are connected to the refrigerant inlet header section (5) and the first intermediate header section (11), respectively. The upper and lower ends of the heat exchange tubes (15) of the rear heat exchange tube group (16) are connected to the refrigerant outlet header section (6) and the second intermediate header section (12), respectively. The refrigerant inlet header section (5) and the second intermediate header section (12) are header sections in which refrigerant flows into the heat exchange tubes (15).

Each of the heat exchange tubes (15) is formed from a bare aluminum extrudate, and assumes a flat form such that its width direction coincides with the front-rear direction. The heat exchange tube (15) has a plurality of refrigerant channels arranged in parallel in the width direction. Each of the corrugated fins (17) is made in a wavy form from an aluminum brazing sheet having a brazing material layer over opposite surfaces thereof. Each of the corrugate fins (17) includes wave crest portions, wave trough portions, and horizontal flat connection portions connecting the wave crest portions and the wave trough portions. A plurality of louvers are formed at the connection portions in such a manner as to be juxtaposed in the front-rear direction. The front and rear heat exchange tubes (15) that constitute the front and rear heat exchange tube groups (16) share the corrugate fins (17). The width of each corrugate fin (17) as measured in the front-rear direction is generally equal to the distance between the front edges of the front heat exchange tubes (15) and the rear edges of the rear heat exchange tubes (15). The wave crest portions and the wave trough portions of the corrugate fins (17) are brazed to the front and rear heat exchange tubes (15). The front edges of the corrugate fins (17) slightly project frontward from the front edges of the front heat exchange tubes (15). Notably, instead of a single corrugate fin being shared between the front and rear heat exchange tube groups (16), a corrugate fin may be disposed between the adjacent heat exchange tubes (15) of each of the front and rear heat exchange tube groups (16).

As shown in FIGS. 2 to 6, the refrigerant inlet/outlet header tank (2) is composed of a plate-like first member (21), a second member (22), a flat partition plate (23), a provisional fixing member (24), and aluminum end members (25) and (26). The first member (21) is formed through press working from an aluminum brazing sheet having a brazing material layer over opposite surfaces thereof. All the heat exchange tubes (15) are connected to the first member (21). The second member (22) is formed through press working from an aluminum brazing sheet having a brazing material layer over opposite surfaces thereof, and covers the upper side (the side opposite the heat exchange tubes (15)) of the first member (21). The partition plate (23) is formed through press working from an aluminum bare material or an aluminum brazing sheet having a brazing material layer over opposite surfaces thereof, and is disposed between the first member (21) and the second member (22) so as to divide the interiors of the refrigerant inlet header section (5) and the refrigerant outlet header section (6) into upper and lower spaces (5*a*) and (5*b*) and into upper and lower spaces (6*a*) and (6*b*), respectively. The provisional fixing member (24) is formed through press working from an aluminum bare material, and is used for provisionally fixing the first member (21), the second member (22), and the partition plate (23). The aluminum end members (25) and (26) are formed through press working from an aluminum brazing sheet having a brazing material layer over opposite surfaces thereof, and are brazed to the left and right ends of the first member (21), the second member (22), and the partition plate (23). A joint plate (27) made of aluminum and elongated in the front-rear direction is brazed to the outer surface of the right end member (26) while extending over the refrigerant inlet header section (5) and the refrigerant outlet header section (6). The refrigerant inlet pipe (8) and the refrigerant outlet pipe (9) are joined to the joint plate (27). Notably, the joint plate (27) is formed from an aluminum bare material through press working.

The first member (21) includes a first header forming portion (28) which bulges downward and forms a lower portion of the refrigerant inlet header section (5); a second header forming portion (29) which bulges downward and forms a lower portion of the refrigerant outlet header section (6); and a connection wall (31) which connects a rear edge portion of the first header forming portion (28) and a front edge portion of the second header forming portion (29) and forms a lower portion of the connection portion (7). The first header forming portion (28) includes a horizontal flat bottom wall (32), and front and rear walls (33) and (34) integrally formed at the front and rear edge portions of the bottom wall (32). The front wall (33) includes a slant portion (33*a*) obliquely extending upward from the front edge of the bottom wall (32) toward the front side, and a vertical portion (33*b*) extending upward from the upper edge of the slant portion (33*a*). The rear wall (34) obliquely extends upward toward the rear side, and its upper end portion extends vertically. The upper end of the front wall (33) is located above that of the rear wall (34). The second header forming portion (29), which is a mirror image of the first header forming portion (28) with respect to the left-right direction, includes a horizontal flat bottom wall (35), and rear and front walls (36) and (37) integrally formed at the rear and front edge portions of the bottom wall (35). The rear wall (36) includes a slant portion (36*a*) obliquely extending upward from the rear edge of the bottom wall (35) toward the rear side, and a vertical portion (36*b*) extending upward from the upper edge of the slant portion (36*a*). The front wall (37) obliquely extends upward toward the front side, and its upper end portion extends vertically. The upper end of the rear wall (36) is located above that of the front wall (37). The upper edge of the rear wall (34) of the first header forming portion (28) and the upper edge of the front wall (37) of the second header forming portion (29) are integrally connected by the connection wall (31).

A plurality of tube insertion holes (38), which are elongated in the front-rear direction, are formed in the two header forming sections (28) and (29) of the first member (21) at predetermined intervals in the left-right direction. The tube insertion holes (38) of the first header forming section (28) and those of the second header forming section (29) are identical in position in the left-right direction. The tube insertion holes (38) of the first header forming section (28) are formed to extend from the slant portion (33*a*) of the front wall (33) to the rear wall (34); and the tube insertion holes (38) of the second header forming section (29) are formed to extend from the slant portion (36*a*) of the rear wall (36) to the front wall (37). Upper end portions of the heat exchange tubes (15) of the front and rear heat exchange tube groups (16) of the heat exchange core section (4) are inserted into the tube insertion holes (38) of the header forming sections (28) and (29), and are brazed to the first member (21) by making use of the brazing material layer of the first member (21). Thus, the upper end portions of the heat exchange tubes (15) of the front heat exchange tube group (16) are connected to the refrigerant inlet header section (5) such that fluid communication is established therebetween; and the upper end portions of the heat exchange tubes (15) of the rear heat exchange tube group (16) are connected to the refrigerant outlet header section (6) such that fluid communication is established therebetween. A plurality of drain through holes (39), which are elongated in the left-right direction, are formed in the connection wall (31) of the first member (21) at predetermined intervals in the left-right direction. Further, a plurality of fixation through holes (41) are formed in the connection wall (31) of the first member (21) at predetermined intervals in the left-right direction such that the fixation through holes (41) are located at positions shifted from the positions of the drain through holes (39). In the present embodiment, the drain through holes (39) and the fixation through holes (41) are formed alternately.

The second member (22) includes a first header forming portion (42) which bulges upward and forms an upper portion of the refrigerant inlet header section (5); a second header forming portion (43) which bulges upward and forms an upper portion of the refrigerant outlet header section (6); and a connection wall (44) which connects these header forming portions (42) and (43) together and forms an upper portion of the connection portion (7). The first header forming portion (42) and the second header forming portion (43) have a generally U-shaped transversal cross section; i.e., they are opened downward, and their central portions in the front-rear direction project upward. Each of the header forming portions (42) and (43) has a plurality of inwardly projecting portions (45) at predetermined intervals in the longitudinal direction thereof. In each of the header forming portions (42) and (43), the inwardly projecting portions (45) extend from outer portions to inner portions of the header forming portion with respect to the front-rear direction. Further, drain through holes (46) are formed in the connection wall (44) at positions corresponding to the drain through holes (39) of the first member (21); and fixation through holes (47) are formed in the connection wall (44) at positions corresponding to the fixation through holes (41) of the first member (21).

The partition plate (23) includes a front partition portion (48) which divides the interior of the refrigerant inlet header section (5) into the upper and lower spaces (5*a*) and (5*b*); a rear partition portion (49) which divides the interior of the refrigerant outlet header section (6) into the upper and lower spaces (6*a*) and (6*b*); and a connection wall (51) which connects the front and rear partition portions (48) and (49), and is sandwiched between and brazed to the connection wall (31) of the first member (21) and the connection wall (44) of the second member (22). The front partition portion (48) of the partition plate (23) has a cutout (52) extending from the left end thereof. Further, in a central portion of the front partition portion (48) with respect to the front-rear direction, a plurality of refrigerant-passage circular through holes (53) are formed at predetermined intervals in the left-right direction so as to establish communication between the upper and lower spaces (5*a*) and (5*b*) of the refrigerant inlet header section (5). Flanges (54) in the form of a short circular tube are integrally formed on the lower surface (the surface facing the heat exchange tubes (15)) of the front partition portion (48) such that the flanges (54) project downward (toward the heat exchange tubes (15)) from the circumferential edges of the corresponding through holes (53) and surround the corresponding through holes (53). Each through hole (53) and the corresponding flange (54) are formed between two adjacent heat exchange tubes (15). Further, in the rear partition portion (49) of the partition plate (23), excluding left and right end portions thereof, a plurality of refrigerant-passage elliptical through holes (55A) and (55B) are formed at predetermined intervals in the left-right direction such that the through holes (55A) and (55B) elongate in the left-right direction and establish communication between the upper and lower spaces (6*a*) and (6*b*) of the refrigerant outlet header section (6). Flanges (56A) and (56B) in the form of a short tube are integrally formed on the upper surface of the rear partition portion (49) such that the flanges (56A) and (56B) project upward from the circumferential edges of the corresponding through holes (55A) and (55B) and surround the corresponding through holes (55A) and (55B). The central elliptical through hole (55A) is shorter than the remaining elliptical through holes (55B), and is located between adjacent heat exchange tubes (15). Further, drain through holes (62) are formed in the connection wall (51) of the partition plate (23) at positions corresponding to the drain through holes (39) of the first member (21) and the drain through holes (46) of the second member (22); and fixation through holes (63) are formed in the connection wall (51) of the partition plate (23) at positions corresponding to the fixation through holes (41) of the first member (21) and the fixation through holes (47) of the second member (22).

The front and rear edge portions of the partition plate (23); i.e., the front edge portion of the front partition portion (48) and the rear edge portion of the rear partition portion (49), each have a receiving groove (57) which opens upward and extends in the left-right direction over the entire length. The second member (22) and the partition plate (23) are brazed together in a state in which a lower end portion of the front wall of the first header forming portion (42) of the second member (22) and a lower end portion of the rear wall of the second header forming portion (43) of the second member (22) are fitted into the corresponding receiving groove (57). Outer walls (57*a*) of the front and rear receiving groove (57)

of the partition plate (23) with respect to the front-rear direction project upward in relation to inner walls of the front and rear receiving groove (57). Further, the outer walls (57*a*) have, at their upper edges, ridges (58) integrally formed over the entire length such that the ridges project outward with respect to the front-rear direction. The first member (21) and the partition plate (23) are brazed together in a state in which the vertical portion (33*b*) of the front wall (33) of the first header forming section (28) of the first member (21) and the vertical portion (36*b*) of the rear wall (36) of the second header forming section (29) run along the outer surfaces of the outer walls (57*a*) of the corresponding receiving grooves (57), and the upper ends of the vertical portions (33*b*) and (36*b*) are in contact with the corresponding ridges (58).

The first header forming portion (28) of the first member (21), the first header forming portion (42) of the second member (22), and the front partition portion (48) of the partition plate (23) form an inlet-header-section main body (60). The second header forming portion (29) of the first member (21), the second header forming portion (43) of the second member (22), and the rear partition portion (49) of the partition plate (23) form an outlet-header-section main body (61).

The provisional fixing member (24) assumes the form of a vertical strip-like plate elongated in the left-right direction. The provisional fixing member (24) has projections (64) which project downward from the lower edge thereof at positions corresponding to the fixation through holes (41), (47), and (63) of the first member (21), the second member (22), and the partition plate (23). The projections (64) are inserted into these fixation through holes (41), (47), and (63), and are brazed to the connection walls (31), (44), and (51). Further, the provisional fixing member (24) has cutouts (65) which extend upward from the lower edge thereof at positions corresponding to the drain through holes (39), (46), and (62) of the first member (21), the second member (22), and the partition plate (23). The width of the opening of each cutout (65) as measured in the left-right direction is equal to that of the drain through holes (39), (46), and (62). The provisional fixing member (24) is formed by performing press working on a plate made of an aluminum bare material such that the projections (64) and the cutouts (65) are formed.

The left end member (25) includes a front cap (25*a*) for closing the left end opening of the inlet-header-section main body (60), and a rear cap (25*b*) for closing the left end opening of the outlet-header-section main body (61). The front cap (25*a*) and the rear cap (25*b*) are integrated together via a connection portion (25*c*). The front cap (25*a*) includes an upper rightward projecting portion (66) and a lower rightward projecting portion (67) integrally formed such that they are separated from each other in the vertical direction. The upper rightward projecting portion (66) is fitted into the space (5*a*) of the inlet-header-section main body (60) located above the front partition portion (48) of the partition plate (23). The lower rightward projecting portion (67) is fitted into the space (5*b*) of the inlet-header-section main body (60) located below the front partition portion (48). Similarly, the rear cap (25*b*) includes an upper rightward projecting portion (68) and a lower rightward projecting portion (69) integrally formed such that they are separated from each other in the vertical direction. The upper rightward projecting portion (68) is fitted into the space (6*a*) of the outlet-header-section main body (61) located above the rear partition portion (49) of the partition plate (23). The lower rightward projecting portion (69) is fitted into the space (6*b*) of the outlet-header-section main body (61) located below the rear partition portion (49). Engagement fingers (71) projecting rightward for engagement with the first and second members (21) and (22) are formed integrally with the left end member (25) at connection portions between the front and rear side edges and the upper and lower edges. The left end member (25) is brazed to the two members (21) and (22) and the partition plate (23) by making use of the brazing material layer of itself. The left end opening of the cutout (52) of the front partition portion (48) is closed by the front cap (25*a*) of the left end member (25) so as to form a communication hole (72) which establishes mutual communication between the upper and lower spaces (5*a*) and (5*b*) of the refrigerant inlet header section (5) at the left end thereof (see FIGS. 5 and 6). Notably, in the present embodiment, the communication hole (72) is formed by means of closing the left end opening of the cutout (52) by the front cap (25*a*). Alternatively, instead of forming the cutout, a through hole may be formed in a left end portion of the front partition portion (48) as the communication hole.

The right end member (26) includes a front cap (26*a*) for closing the right end opening of the inlet-header-section main body (60), and a rear cap (26*b*) for closing the right end opening of the outlet-header-section main body (61). The front cap (26*a*) and the rear cap (26*b*) are integrated together via a connection portion (26*c*). The front cap (26*a*) of the right end member (26) includes an upper leftward projecting portion (73) and a lower leftward projecting portion (74) integrally formed such that they are separated from each other in the vertical direction. The upper leftward projecting portion (73) is fitted into the space (5*a*) of the inlet-header-section main body (60) located above the front partition portion (48) of the partition plate (23). The lower leftward projecting portion (74) is fitted into the space (5*b*) of the inlet-header-section main body (60) located below the front partition portion (48). Similarly, the rear cap (26*b*) includes an upper leftward projecting portion (75) and a lower rightward projecting portion (76) integrally formed such that they are separated from each other in the vertical direction. The upper leftward projecting portion (75) is fitted into the space (6*a*) of the outlet-header-section main body (61) located above the rear partition portion (49) of the partition plate (23). The lower leftward projecting portion (76) is fitted into the space (6*b*) of the outlet-header-section main body (61) located below the rear partition portion (49). A refrigerant inlet (77) is formed in a projecting end wall of the upper leftward projecting portion (73) of the front cap (26*a*) of the right end member (26). Similarly, a refrigerant outlet (78) is formed in a projecting end wall of the upper leftward projecting portion (75) of the rear cap (26*b*) of the right end member (26). Engagement fingers (79) projecting leftward for engagement with the first and second members (21) and (22) are formed integrally with the right end member (26) at connection portions between the front and rear side edges and the upper edge, and at front and rear portions of the lower edge.

Figure 7:
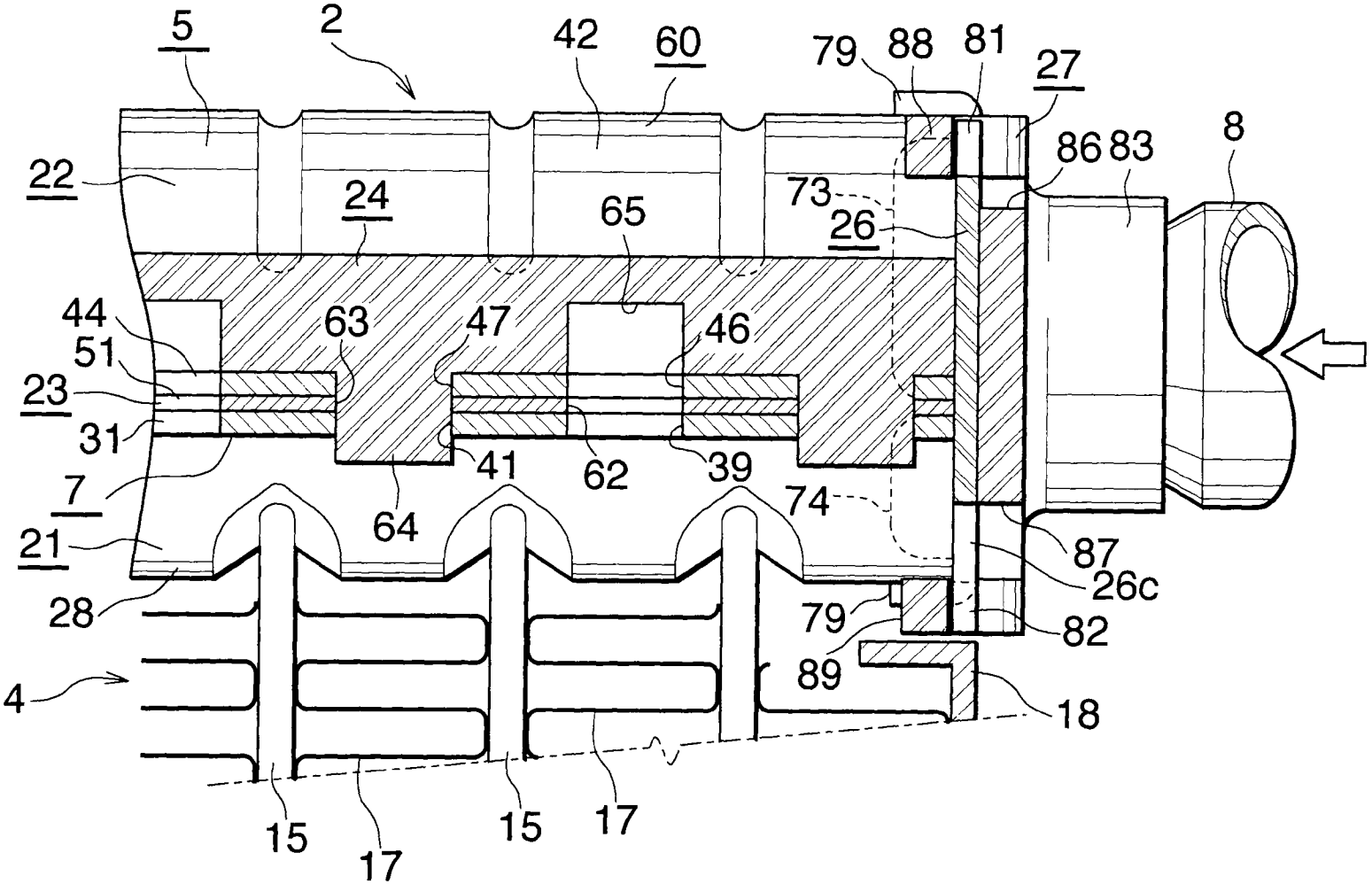
FIG. 7 is an enlarged cross sectional view taken along line D-D of FIG. 5.
Figure 8:
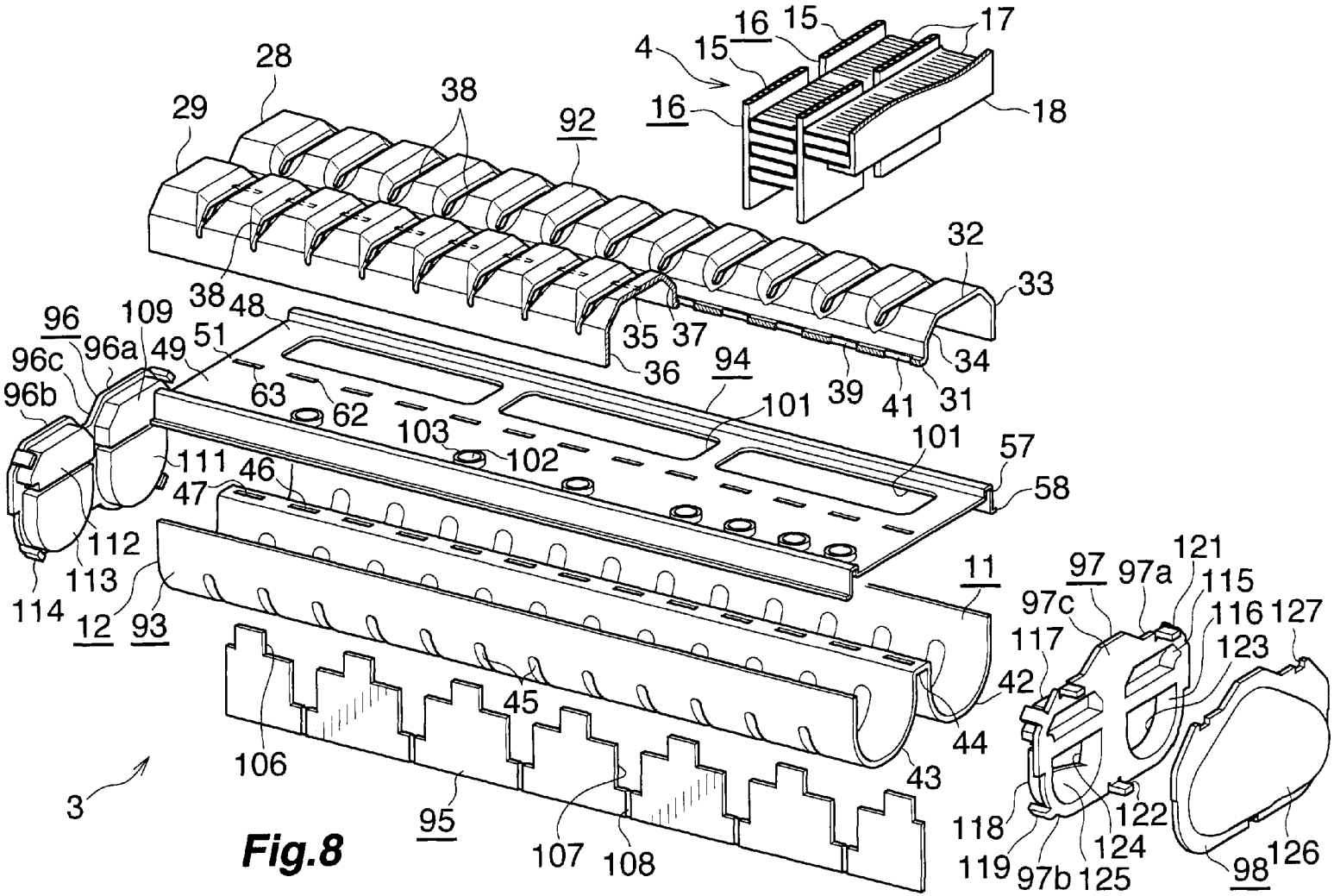
FIG. 8 is an exploded perspective view of a refrigerant turn header tank of the evaporator shown in FIG. 1.
Figure 9:
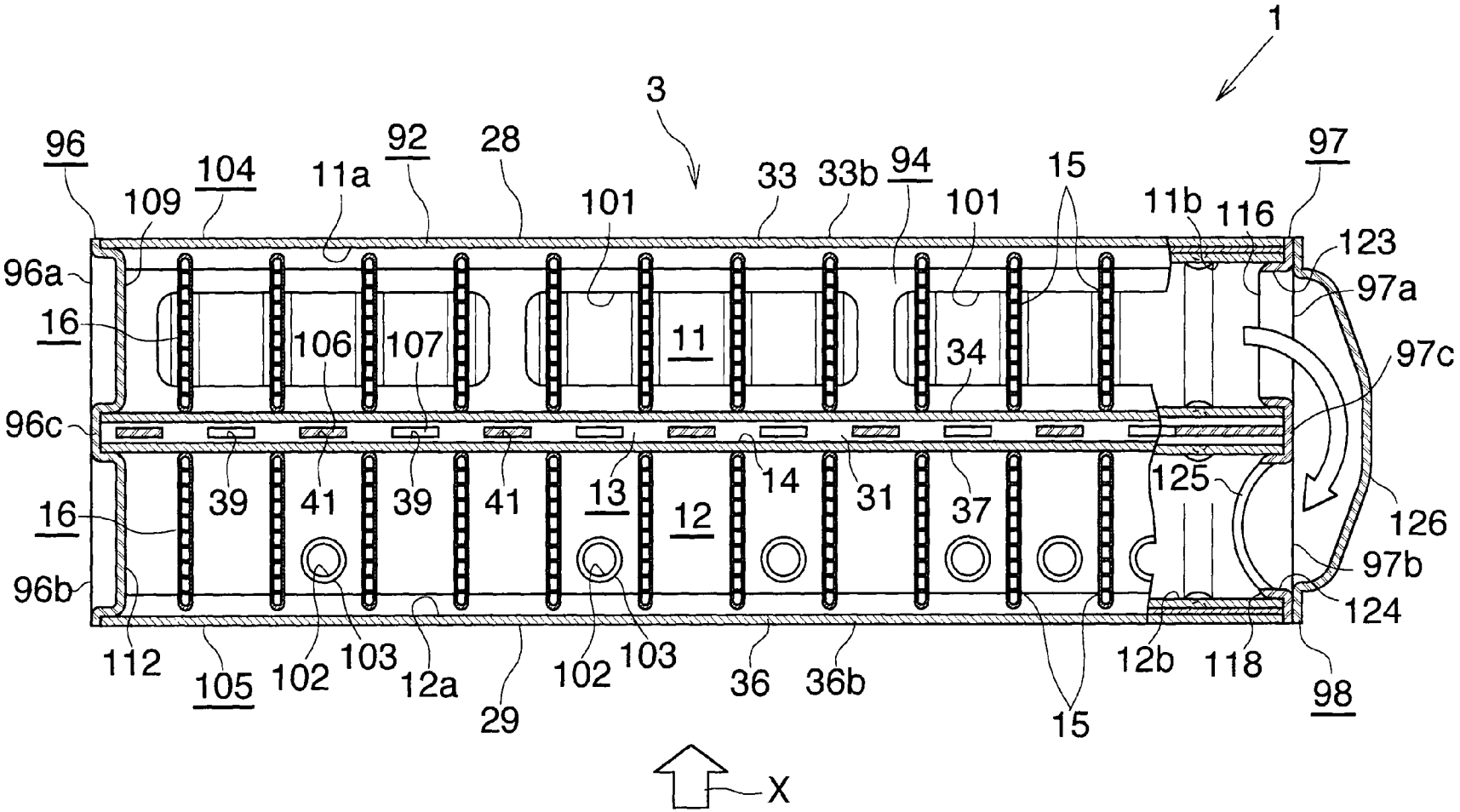
FIG. 9 is an enlarged cross sectional view taken along line E-E of FIG. 2.

As shown in FIGS. 3 and 7, a first engagement male portion (81) is formed integrally with the connection portion (26*c*) of the right end member (26) such that the first engagement male portion (81) projects upward from a central portion of the upper end of the connection portion (26*c*) with respect to the front-rear direction. Similarly, a second engagement male portion (82) is formed integrally with the connection portion (26*c*) of the right end member (26) such that the second engagement male portion (82) projects downward from a central portion of the lower end of the connection portion (26*c*) with respect to the front-rear direction. In a state before the right end member (26) is assembled to the joint plate (27) during the manufacture of the evaporator (1), the second engagement male portion (82) projects rightward. Further, cutouts (80) are formed in front and rear end potions of a lower edge portion of the right end member (26). The right end member (26) is brazed to the members (21) and (22) and the partition plate (23) by making use of the brazing material layer of itself.

The joint plate (27) includes a short, cylindrical refrigerant inflow port (83) communicating with the refrigerant inlet (77) of the right end member (26), and a short, cylindrical refrigerant outflow port (84) communicating with the refrigerant outlet (78) of the right end member (26). The refrigerant inflow port (83) and the refrigerant outflow port (84) are each composed of a circular through hole and a short cylindrical tubular portion formed integrally with the joint plate (27) such that the short cylindrical tubular portion surrounds the through hole and projects rightward.

The joint plate (27) has a vertically extending slit for short prevention (85) formed between the refrigerant inflow port (83) and the refrigerant outflow port (84), and generally trapezoidal through holes (86) and (87) communicating with the upper and lower ends of the slit (85), respectively. Portions of the joint plate (27) located above the upper through hole (86) and below the lower through hole (87) are bent in a U-like shape so as to project leftward (toward the right end member (26)) to thereby form first and second engagement female portions (88) and (89). The first engagement male portion (81) of the right end member (26) is inserted into the first engagement female portion (88) from the lower side thereof for engagement with the first engagement female portion (88). The second engagement male portion (82) of the right end member (26) is inserted into the second engagement female portion (89) from the upper side thereof for engagement with the second engagement female portion (89). Thus, movement of the joint plate (27) in the left-right direction is prevented. The second engagement male portion (82) of the right end member (26) in a state in which it projects rightward is passed through the lower through hole (87), and then bent downward, whereby the second engagement male portion (82) is inserted into the second engagement female portion (89) from the upper side thereof. The first engagement female portion (88) is in engagement with front and rear side portions of the first engagement male portion (81) of the connection portion (26*c*) of the right end member (26), whereby downward movement of the joint plate (27) is prevented. Moreover, engagement fingers (91) projecting leftward are formed integrally with the joint plate (27) at front and rear end portions of the lower edge thereof. The joint plate (27) is engaged with the right end member (26) with the engagement fingers (91) fitted into the cutouts (80) formed along the lower edge of the right end member (26). Thus, upward, frontward, and rearward movements of the joint plate (27) are prevented. The joint plate (27) is brazed to the right end member (26) by making use of the brazing material layer of the right end member (26) in a state in which the joint plate (27) is engaged with the right end member (26) such that leftward and rightward movements, upward and downward movements, and frontward and rearward movements of the joint plate (27) are prevented as described above.

A diameter-reduced portion of the refrigerant inlet pipe (8) formed at one end thereof is inserted into and brazed to the refrigerant inflow port (83) of the joint plate (27). Similarly, a diameter-reduced portion of the refrigerant outlet pipe (9) formed at one end thereof is inserted into and brazed to the refrigerant inflow port (84) of the joint plate (27). Although not illustrated in the drawings, an expansion valve attachment member is joined to the opposite end portions of the refrigerant inlet pipe (8) and the refrigerant outlet pipe (9) such that the expansion valve attachment member extends over the two pipes (8) and (9).

As shown in FIGS. 2, 3, 8, and 9, the refrigerant turn header tank (3) is composed of a plate-like first member (92), a second member (93), a partition plate (94), a provisional fixing member (95), aluminum end members (96) and (97), and a communication member (98). The first member (92) is formed through press working from an aluminum brazing sheet having a brazing material layer over opposite surfaces thereof. All the heat exchange tubes (15) are connected to the first member (92). The second member (93) is formed through press working from an aluminum brazing sheet having a brazing material layer over opposite surfaces thereof, and covers the lower side (the side opposite the heat exchange tubes (15)) of the first member (92). The partition plate (94) is formed through press working from an aluminum bare material or an aluminum brazing sheet having a brazing material layer over opposite surfaces thereof, and is disposed between the first member (92) and the second member (93) so as to divide the interiors of the first intermediate header section (11) and the second intermediate header section (12) into upper and lower spaces (11*a*) and (11*b*) and into upper and lower spaces (12*a*) and (12*b*), respectively. The provisional fixing member (95) is formed through press working from an aluminum bare material, and is used for provisionally fix the first member (92), the second member (93), and the partition plate (94). The aluminum end members (96) and (97) are formed through press working from an aluminum brazing sheet having a brazing material layer over opposite surfaces thereof, and are brazed to the left and right ends of the first member (92), the second member (93), and the partition plate (94). The communication member (98), which is made of an aluminum bare material and extends in the front-rear direction, is brazed to an outer surface of the right end member (97) such that the communication member (98) extends over the first intermediate header section (11) and the second intermediate header section (12). The first intermediate header section (11) and the second intermediate header section (12) communicate with each other at their right ends via the communication member (98).

The first member (92) has the same structure as the first member (21) of the refrigerant inlet/outlet header tank (2), and is a mirror image of the first member (21) with respect to the vertical direction. Like portions are denoted by like reference numerals. A first header forming portion (28) forms an upper portion (a vertically inside portion) of the first intermediate header section (11); and a second header forming portion (29) forms an upper portion (a vertically inside portion) of the second intermediate header section (12). Lower end portions of the heat exchange tubes (15) of the front and rear heat exchange tube groups (16) of the heat exchange core section (4) are inserted into tube insertion holes (38), and are brazed to the first member (92) by making use of the brazing material layer of the first member (92). Thus, the lower end portions of the heat exchange tubes (15) of the front heat exchange tube group (16) are connected to the first intermediate header section (11) such that fluid communication is established therebetween; and the lower end portions of the heat exchange tubes (15) of the rear heat exchange tube group (16) are connected to the second intermediate header section (12) such that fluid communication is established therebetween.

The second member (93) has the same structure as the second member (22) of the refrigerant inlet/outlet header tank (2), and is a mirror image of the second member (22) with respect to the vertical direction. Like portions are denoted by like reference numerals. A first header forming portion (42) forms a lower portion of the first intermediate header section (11); and a second header forming portion (43) forms a lower portion of the second intermediate header section (12).

The partition plate (94) has the same structure as the partition plate (23) of the refrigerant inlet/outlet header tank (2), except for the structure of the front and rear partition portions (48) and (49), and is a mirror image of the partition plate (23) with respect to the vertical direction. Like portions are denoted by like reference numerals. The front partition portion (48), which divides the interior of the first intermediate header section (11) into upper and lower spaces (11*a*) and (11*b*), has a plurality of relatively large rectangular through holes (101) formed at predetermined intervals in the left-right direction such that they extend in the left-right direction. Further, the rear partition portion (49), which divides the interior of the second intermediate header section (12) into upper and lower spaces (12*a*) and (12*b*), has a plurality of circular refrigerant-passage through holes (102) formed at predetermined intervals in the left-right direction. The distance between adjacent circular refrigerant-passage through holes (102) gradually increases with the distance from the right end. Flanges (103) in the form of a short circular tube are integrally formed on the upper surface (the surface facing the heat exchange tubes (15)) of the rear partition portion (49) such that the flanges (103) project upward (toward the heat exchange tubes (15)) from the corresponding through holes (102) and surround the corresponding through holes (102). Each through hole (102) and the corresponding flange (103) are formed between two adjacent heat exchange tubes (15). Notably, the distance between adjacent circular refrigerant-passage through holes (102) may be constant among all the circular refrigerant-passage through holes (102).

The first member (92), the second member (93), and the partition plate (94) are assembled and brazed together in the same manner as in the case of the first member (21), the second member (22), and the partition plate (23) of the refrigerant inlet/outlet header tank (2). Thus, the first header forming portion (28) of the first member (92), the first header forming portion (42) of the second member (93), and the front partition portion (48) of the partition plate (94) form a first-intermediate-section main body (104), which is hollow and is opened at opposite ends thereof; and the second header forming portion (29) of the first member (92), the second header forming portion (43) of the second member (93), and the rear partition portion (49) of the partition plate (94) form a second-intermediate-section main body (105), which is hollow and is opened at opposite ends thereof.

The provisional fixing member (95) assumes the form of a vertical strip-like plate elongated in the left-right direction. The provisional fixing member (95) has projections (106) which project upward from the upper edge thereof at positions corresponding to fixation through holes (41), (47), and (63) of the first member (92), the second member (93), and the partition plate (94). The projections (106) are inserted into these fixation through holes (41), (47), and (63), and are brazed to connection walls (31), (44), and (51). Further, the provisional fixing member (95) has cutouts (107) which extend downward from the upper edge thereof at positions corresponding to drain through holes (39), (46), and (62) of the first member (92), the second member (93), and the partition plate (94). The width of the opening of each cutout (107) as measured in the left-right direction is equal to that of the drain through holes (39), (46), and (62). Drain assisting grooves (108) are formed on the front and rear surfaces of the provisional fixing member (95) such that the drain assisting grooves (108) extend downward from the lower ends of the cutouts (107), and the lower ends of the drain assisting grooves (108) are opened to the lower end surface of the provisional fixing member (95). The provisional fixing member (95) is formed by performing press working on a plate made of an aluminum bare material such that the projections (106), the cutouts (107), and the drain assisting grooves (108) are formed.

The left end member (96) is a mirror image of the left end member (25) of the refrigerant inlet/outlet header tank (2) with respect to the vertical direction. The left end member (96) includes a front cap (96*a*) for closing the left end opening of the first-intermediate-header-section main body (104), and a rear cap (96*b*) for closing the left end opening of the second-intermediate-header-section main body (105). The front cap (96*a*) and the rear cap (96*b*) are integrated together via a connection portion (96*c*). The front cap (96*a*) includes an upper rightward projecting portion (109) and a lower rightward projecting portion (111) integrally formed such that they are separated from each other in the vertical direction. The upper rightward projecting portion (109) is fitted into the space (11*a*) of the first-intermediate-header-section main body (104) located above the front partition portion (48) of the partition plate (94). The lower rightward projecting portion (111) is fitted into the space (11*b*) of the first-intermediate-header-section main body (104) located below the front partition portion (48). Similarly, the rear cap (96*b*) includes an upper rightward projecting portion (112) and a lower rightward projecting portion (113) integrally formed such that they are separated from each other in the vertical direction. The upper rightward projecting portion (112) is fitted into the space (12*a*) of the second-intermediate-header-section main body (105) located above the rear partition portion (49) of the partition plate (94). The lower rightward projecting portion (113) is fitted into the space (12*b*) of the second-intermediate-header-section main body (105) located below the rear partition portion (49). Engagement fingers (114) projecting rightward for engagement with the first and second members (92) and (93) are formed integrally with the left end member (96) at connection portions between the front and rear side edges and the upper and lower edges. The left end member (96) is brazed to the two members (92) and (93) and the partition plate (94) by making use of the brazing material layer of itself.

The right end member (97) includes a front cap (97*a*) for closing the right end opening of the first-intermediate-header-section main body (104), and a rear cap (97*b*) for closing the right end opening of the second-intermediate-header-section main body (105). The front cap (97*a*) and the rear cap (97*b*) are integrated together via a connection portion (97*c*). The front cap (97*a*) includes an upper leftward projecting portion (115) and a lower leftward projecting portion (116) integrally formed such that they are separated from each other in the vertical direction. The upper leftward projecting portion (115) is fitted into the space (11*a*) of the first-intermediate-header-section main body (104) located above the front partition portion (48) of the partition plate (94). The lower leftward projecting portion (116) is fitted into the space (11*b*) of the first-intermediate-header-section main body (104) located below the front partition portion (48). Similarly, the rear cap (97*b*) includes an upper leftward projecting portion (117) and a lower rightward projecting portion (118) integrally formed such that they are separated from each other in the vertical direction. The upper leftward projecting portion (117) is fitted into the space (12*a*) of the second-intermediate-header-section main body (105) located above the rear partition portion (49) of the partition plate (94). The lower leftward projecting portion (118) is fitted into the space (12*b*) of the second-intermediate-header-section main body (105) located below the rear partition portion (49). Engagement fingers (119) projecting leftward for engagement with the first and second members (92) and (93) are formed integrally with the right end member (97) at connection portions between the front and rear side edges and the upper and lower edges.

The right end member (97) has integrally formed engagement fingers (121) which project rightward from front and rear end portions of the upper edge of the right end member (97). The engagement fingers (121) are bent downward for engagement with an upper edge portion of the communication member (98). The right end member (97) also has an integrally formed engagement finger (122) which projects rightward from a central portion of the lower edge of the right end member (97) with respect to the front-rear direction. The engagement finger (122) is bent upward for engagement with a lower edge portion of the communication member (98). Notably, in FIG. 8, the engagement fingers (121) and (122) are shown in a straight state before being bent. A refrigerant outflow opening (123) is formed in a projecting end wall of the lower leftward projecting portion (116) of the front cap (97*a*) of the right end member (97) so as to allow refrigerant to flow out of the space (11*b*) of the first intermediate header section (11) located below the front partition portion (48). Similarly, a refrigerant inflow opening (124) is formed in a projecting end wall of the lower leftward projecting portion (118) of the rear cap (97*b*) of the right end member (97) so as to allow refrigerant to flow into the space (12*b*) of the second intermediate header section (12) located below the rear partition portion (49). Further, a guide portion (125), which is upwardly inclined or curbed (in the present embodiment, curved) toward the interior of the second intermediate header section (12), is integrally formed at a lower portion of the circumferential edge of the refrigerant inflow opening (124) of the lower leftward projecting portion (118) of the rear cap (97*b*). The guide portion (125) guides upward the refrigerant flowing into the space (12*b*) of the second intermediate header section (12) located below the rear partition portion (49). The right end member (97) is brazed to the first and second members (92) and (93) and the partition plate (94) by making use of the brazing material layer of itself.

The communication member (98) is formed from an aluminum bare material through press working, and assumes the form of a plate whose outer shape is identical in shape and size with the right end member (97) as viewed from the right. A circumferential edge portion of the communication member (98) is brazed to the outer surface of the right end member (97) by making use of the brazing material layer of the right end member (97). The communication member (98) has an outwardly bulging portion (126) for establishing communication between the refrigerant outflow opening (123) and the refrigerant inflow opening (124) of the right end member (97). The interior of the outwardly bulging portion (126) serves as a communication passage for establishing communication between the refrigerant outflow opening (123) and the refrigerant inflow opening (124) of the right end member (97). Cutouts (127) for receiving the engagement fingers (121) and (122) of the right end member (97) are formed at front end rear end portions of the upper edge of the communication member (98), as well as at a central portion of the lower edge of the communication member (98) with respect to the front-rear direction.

In manufacture of the above-described evaporator (1), all the components thereof, excluding the inlet pipe (8) and the outlet pipe (9), are assembled together, and the resultant assembly is subjected to batch brazing.

The evaporator (1), together with a compressor and a condenser (serving as a refrigerant cooler), constitutes a refrigeration cycle, which uses a chlorofluorocarbon-based refrigerant and is installed in a vehicle, for example, an automobile, as a car air conditioner.

In the evaporator (1) described above, when the compresses is on, two-phase refrigerant of vapor-liquid phase having passed through the compressor, the condenser and an expansion valve enters the upper space (5*a*) of the refrigerant inlet header section (5) of the refrigerant inlet/outlet header tank (2) from the refrigerant inlet pipe (8) through the refrigerant inflow port (83) of the joint plate (27) and the refrigerant inlet (77) of the front cap (26*a*) of the right end member (26). Then, the refrigerant having entered the upper space (5*a*) of the refrigerant inlet header section (5) flows leftward and subsequently flows into the lower space (5*b*) via the through holes (72), as well as the through holes (53) of the front partition portion (48) of the partition plate (23).

The refrigerant having entered the lower space (5*b*) dividedly flows into the refrigerant channels of the heat exchange tubes (15) of the front heat exchange tube group (16). The refrigerant having entered the refrigerant channels of the heat exchange tubes (15) flows downward through the refrigerant channels and enters the upper space (11*a*) of the first intermediate header section (11) of the refrigerant turn header tank (3). The refrigerant having entered the upper space (11*a*) of the first intermediate header section (11) enters the lower space (11*b*) via the through holes (101) of the front partition portion (48) of the partition plate (94), and then flows rightward in the lower space (11*b*). The refrigerant then flows through the refrigerant outflow opening (123) of the front cap (97*a*) of the right end member (97), the communication passage within the outward bulging portion (126) of the communication member (98), and the refrigerant inflow opening (124) of the rear cap (97*b*), thereby turning its flow direction and entering the lower space (12*b*) of the second intermediate header section (12).

The refrigerant having entered the lower space (12*b*) of the second intermediate header section (12) flows leftward; enters the upper space (12*a*) via the through holes (102) of the rear partition portion (49) of the partition member (94); and dividedly flows into the refrigerant channels of the heat exchange tubes (15) of the rear heat exchange tube group (16). At that time, the guide portion (125) guides the refrigerant to flow in an upwardly inclined leftward direction; i.e., flow into the lower space (12*b*) toward the rear partition portion (49). As a result, in cooperation with the through holes (102) formed in the rear partition portion (49) such the distance between adjacent through holes (102) gradually increases toward the left end, the distribution (in the left-right direction) of the refrigerant flowing into the upper space (12*a*) via the through holes (102) is made uniform as compared with the case where the guide portion (125) is not provided. Therefore, the refrigerant becomes more likely to uniformly flow into the heat exchange tubes (15) connected to the second intermediate header section (12). Accordingly, the distribution of the refrigerant in the heat exchange core section (4) hardly becomes non-uniform, whereby the temperature of air having passed through the heat exchange core section (4) becomes uniform, and the heat exchange performance is improved.

The refrigerant having flown into the refrigerant channels of the heat exchange tubes (15) flows upward within the refrigerant channels, while changing its flow direction; enters the lower space (6*b*) of the refrigerant outlet header section (6); and enters the upper space (6*a*) through the through holes (55A) and (55B) of the rear partition portion (49) of the partition plate (23).

Next, the refrigerant having entered the upper space (6*a*) of the refrigerant outlet header section (6) flows rightward, and flows out to the refrigerant outlet pipe (9) through the refrigerant outlet (78) of the rear cap (26*b*) of the right end member (26) and the refrigerant outflow port (84) of the joint plate (27).

While flowing through the refrigerant channels of the heat exchange tubes (15) of the front and rear heat exchange tube groups (16), the refrigerant is subjected to heat exchange with the air flowing through the air-passing clearances of the heat exchange core section (4), and flows out from the evaporator (1) in a vapor phase.

FIGS. 10 to 19 show modifications of the partition plate used in the refrigerant inlet/outlet header tank (2) and the refrigerant turn header tank (3).

Figure 10:
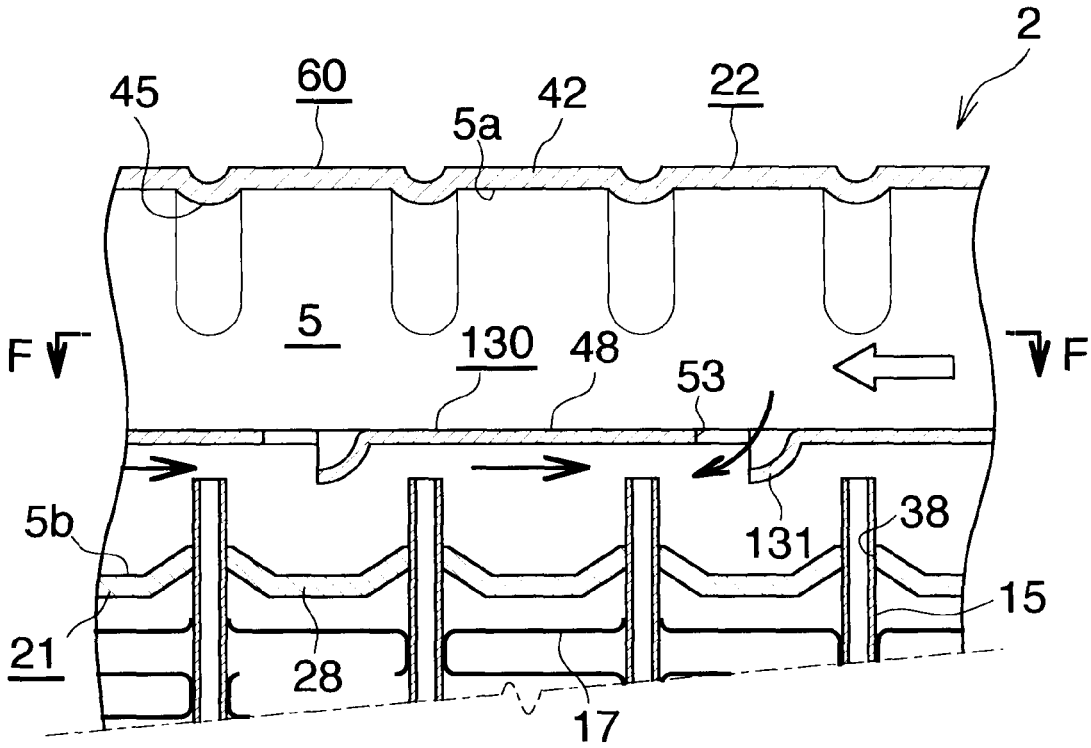
FIG. 10 is a view corresponding to a main portion of FIG. 6 and showing a first modification of the partition plate.
Figure 11:
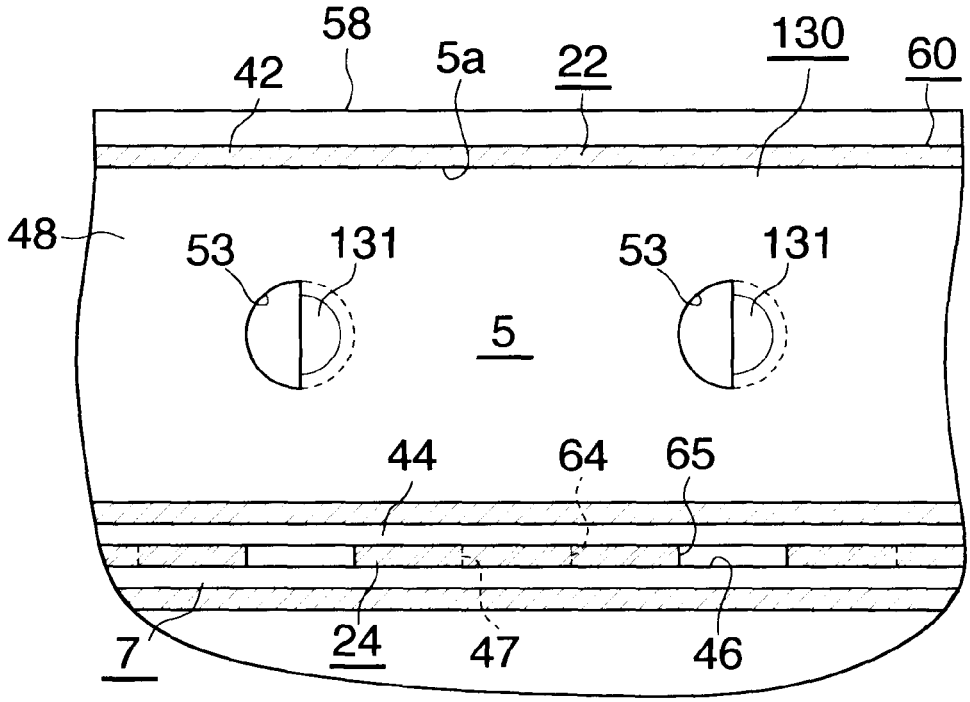
FIG. 11 is a cross sectional view taken along line F-F of FIG. 10.

In the case of a partition plate (130) used in the refrigerant inlet/outlet header tank (2) shown in FIGS. 10 and 11, in an intermediate portion (with respect to the front-rear direction) of the front partition portion (48), which divides the interior of the refrigerant inlet header section (5) into the upper and lower spaces (5*a*) and (5*b*), a plurality of refrigerant-passage circular through holes (53) are formed at predetermined intervals in the left-right direction so as to establish communication between the upper and lower spaces (5*a*) and (5*b*) of the refrigerant inlet header section (5). Guide portions (131) in the form of a quarter-sphere are integrally formed on the lower surface (the surface facing the heat exchange tubes (15)) of the front partition portion (48) at positions corresponding to the through holes (53) such that the guide portions (131) project from portions of the circumferential edges of the corresponding through holes (53), the portions being located on the upstream sides of the through holes with respect to the flow direction of refrigerant in the upper space (5*a*) of the refrigerant inlet header section (5) (a space of the header section in which the refrigerant flows into the heat exchange tubes, the space being opposite the heat exchange tubes). The guide portions (131) are curved downward toward the left. Each through hole (53) and the corresponding guide (131) are formed between two adjacent heat exchange tubes (15). The other structural features are identical with those of the partition plate (23) of the above-described embodiment.

Notably, although not illustrated in the drawings, the partition plate (130) may be used in the refrigerant turn tank (3). In this case, in the rear partition portion (49), which divides the interior of the second intermediate header section (12) into the upper and lower spaces (12*a*) and (12*b*), a plurality of circular refrigerant-passage through holes (102) are formed at predetermined intervals in the left-right direction so as to establish communication between the upper and lower spaces (12*a*) and (12*b*) of the second intermediate header section (12). Guide portions (131) in the form of a quarter-sphere are integrally formed on the upper surface (the surface facing the heat exchange tubes (15)) of the rear partition portion (49) at positions corresponding to the through holes (102) such that the guide portions (131) project upward from portions of the circumferential edges of the corresponding through holes (102), the portions being located on the upstream sides of the through holes with respect to the flow direction of refrigerant in the lower space (12*b*) of the second intermediate header section (12) (a space of the header section in which the refrigerant flows into the heat exchange tubes, the space being opposite the heat exchange tubes). The guide portions (131) are curved upward toward the left. When the partition plate (130) is used in the refrigerant turn tank (3), the guide portions (131) may be formed on the lower surface (the surface opposite the heat exchange tubes (15)) of the rear partition portion (49) at positions corresponding to the through holes (102) such that the guide portions (131) project from the portions of the circumferential edges of the corresponding through holes (102), the portions being located on the downstream sides of the through holes with respect to the flow direction of refrigerant in the lower space (12*b*) of the second intermediate header section (12) (a space of the header section in which the refrigerant flows into the heat exchange tubes, the space being opposite the heat exchange tubes).

Figure 12:
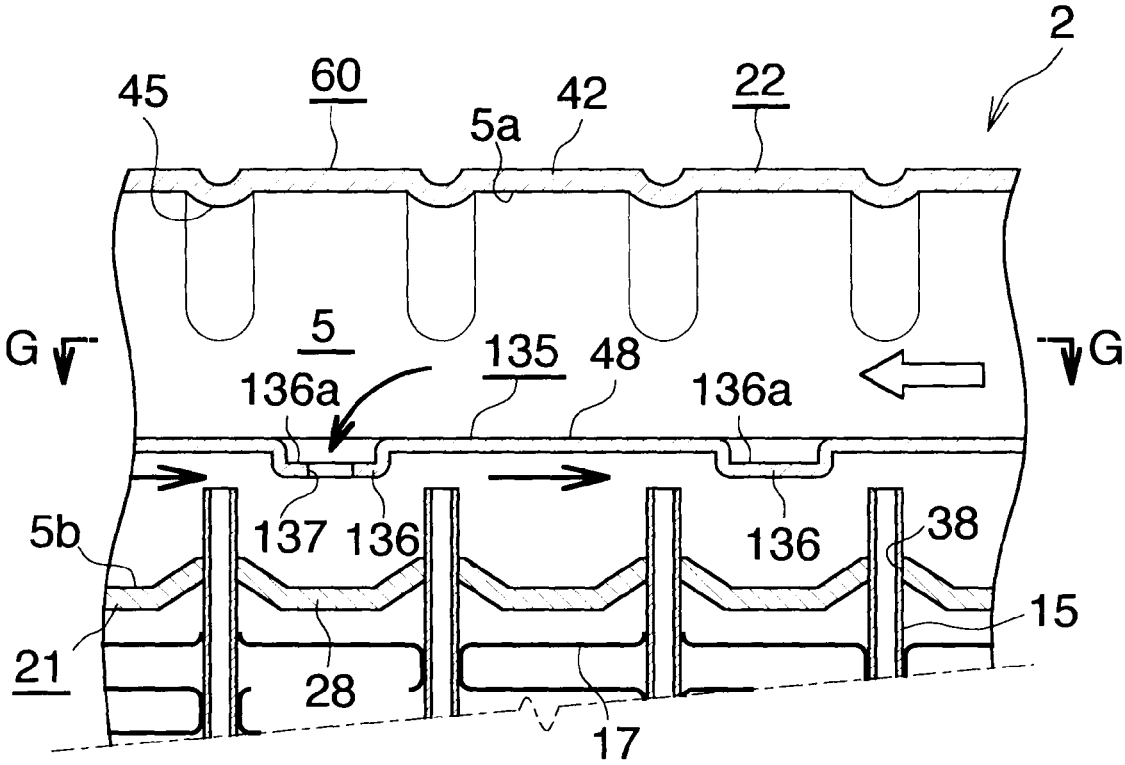
FIG. 12 is a view corresponding to the main portion of FIG. 6 and showing a second modification of the partition plate.
Figure 13:
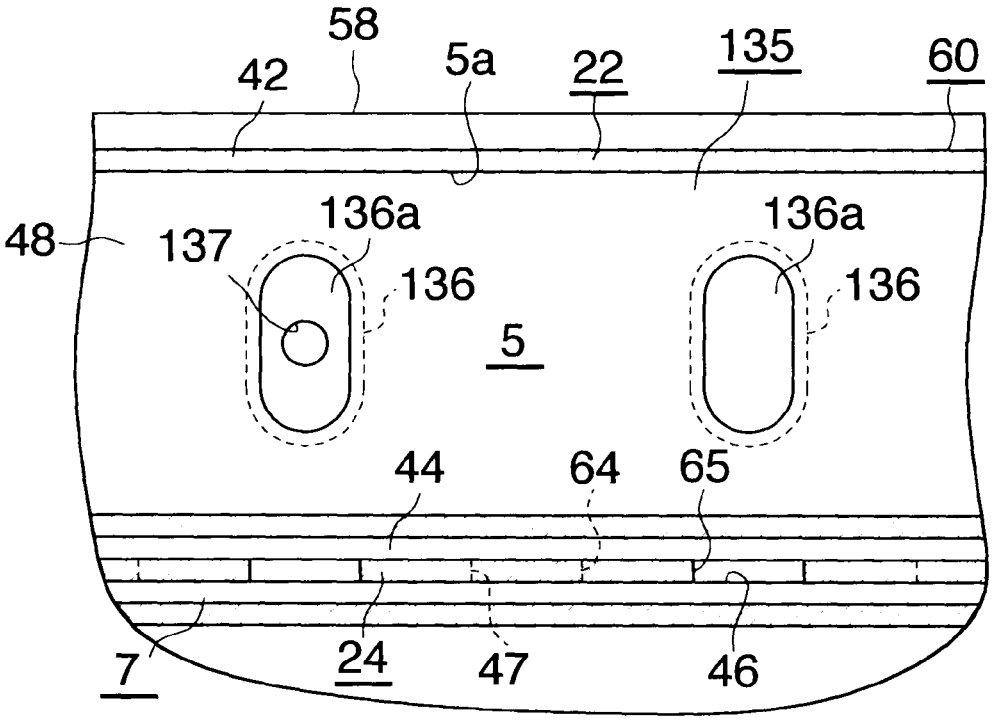
FIG. 13 is a cross sectional view taken along line G-G of FIG. 12.

In the case of a partition plate (135) used in the refrigerant inlet/outlet header tank (2) shown in FIGS. 12 and 13, on the front partition portion (48), which divides the interior of the refrigerant inlet header section (5) into the upper and lower spaces (5*a*) and (5*b*), a plurality of bulging portions (136) are integrally formed at predetermined intervals in the left-right direction such that the bulging portions (136) project downward (toward the heat exchange tubes (15)) and each have a flat bulging end wall (136*a*). Of all the bulging portions (136), those at proper locations have refrigerant-passage through holes (137) formed in their bulging end walls (136*a*). Each bulging portion (136) is formed between two adjacent heat exchange tubes (15). The other structural features are identical with those of the partition plate (23) of the above-described embodiment.

Notably, although not illustrated in the drawings, the partition plate (135) may be used in the refrigerant turn tank (3). In this case, on the rear partition portion (49), which divides the interior of the second intermediate header section (12) into the upper and lower spaces (12*a*) and (12*b*), a plurality of bulging portions (136) are integrally formed at predetermined intervals in the left-right direction such that the bulging portions (136) project upward (toward the heat exchange tubes (15)) and each have a flat bulging end wall (136*a*). Of all the bulging portions (136), those at proper locations have refrigerant-passage through holes (137) formed in their bulging end walls (136*a*). Each bulging portion (136) is formed between two adjacent heat exchange tubes (15).

Figure 14:
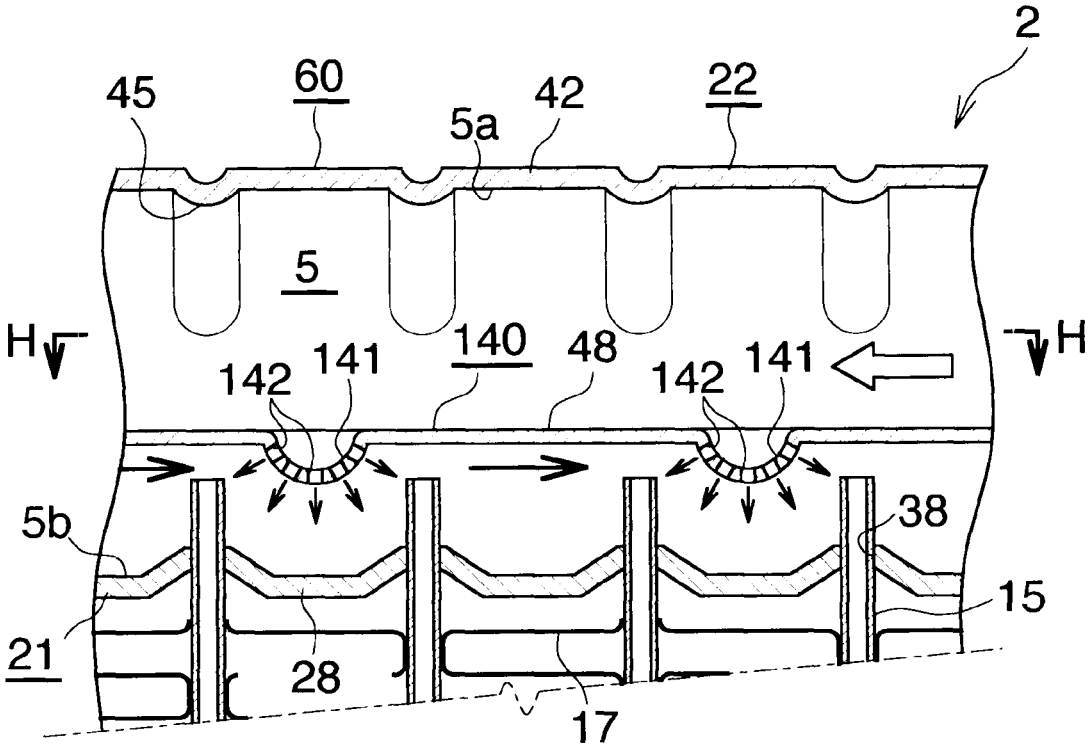
FIG. 14 is a view corresponding to the main portion of FIG. 6 and showing a third modification of the partition plate.
Figure 15:
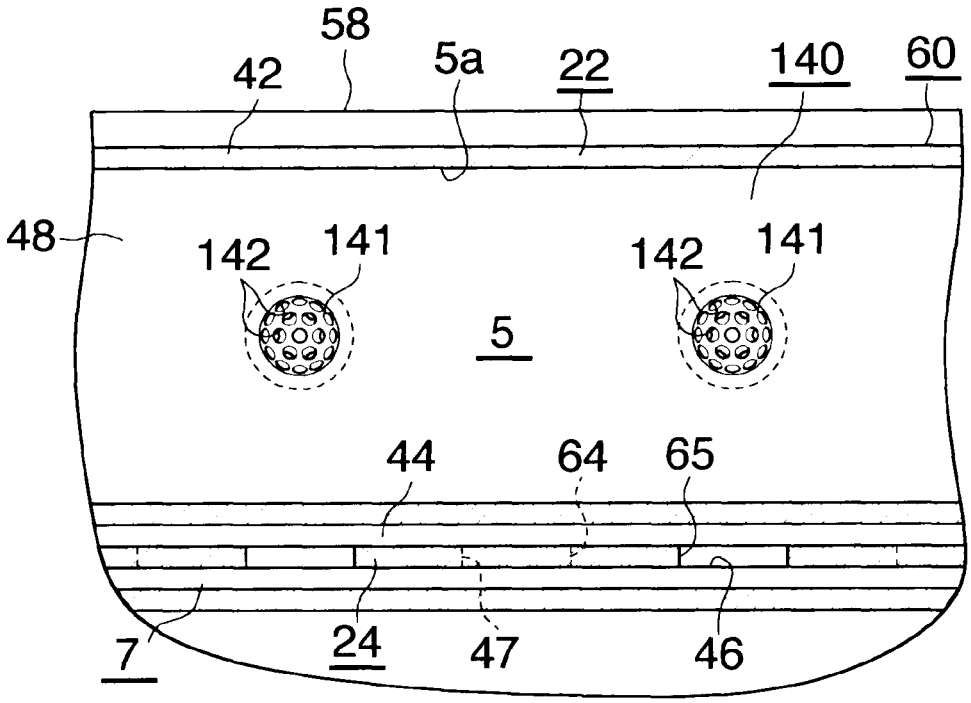
FIG. 15 is a cross sectional view taken along line H-H of FIG. 14.

In the case of a partition plate (140) used in the refrigerant inlet/outlet header tank (2) shown in FIGS. 14 and 15, hemispherical bulging portions (141) are integrally formed on the front partition portion (48), which divides the interior of the refrigerant inlet header section (5) into the upper and lower spaces (5*a*) and (5*b*), such that the bulging portions (141) project downward (toward the heat exchange tubes (15)). Of all the bulging portions (141), those at proper locations have a plurality of refrigerant-passage through holes (142) radially formed therein. Each bulging portion (141) is formed between two adjacent heat exchange tubes (15). The other structural features are identical with those of the partition plate (23) of the above-described embodiment.

Notably, although not illustrated in the drawings, the partition plate (140) may be used in the refrigerant turn tank (3). In this case, hemispherical bulging portions (141) are integrally formed on the rear partition portion (49), which divides the interior of the second intermediate header section (12) into the upper and lower spaces (12*a*) and (12*b*), such that the bulging portions (141) project upward (toward the heat exchange tubes (15)). Of all the bulging portions (141), those at proper locations have a plurality of refrigerant-passage through holes (142) radially formed therein. Each bulging portion (141) is formed between two adjacent heat exchange tubes (15).

Figure 16:
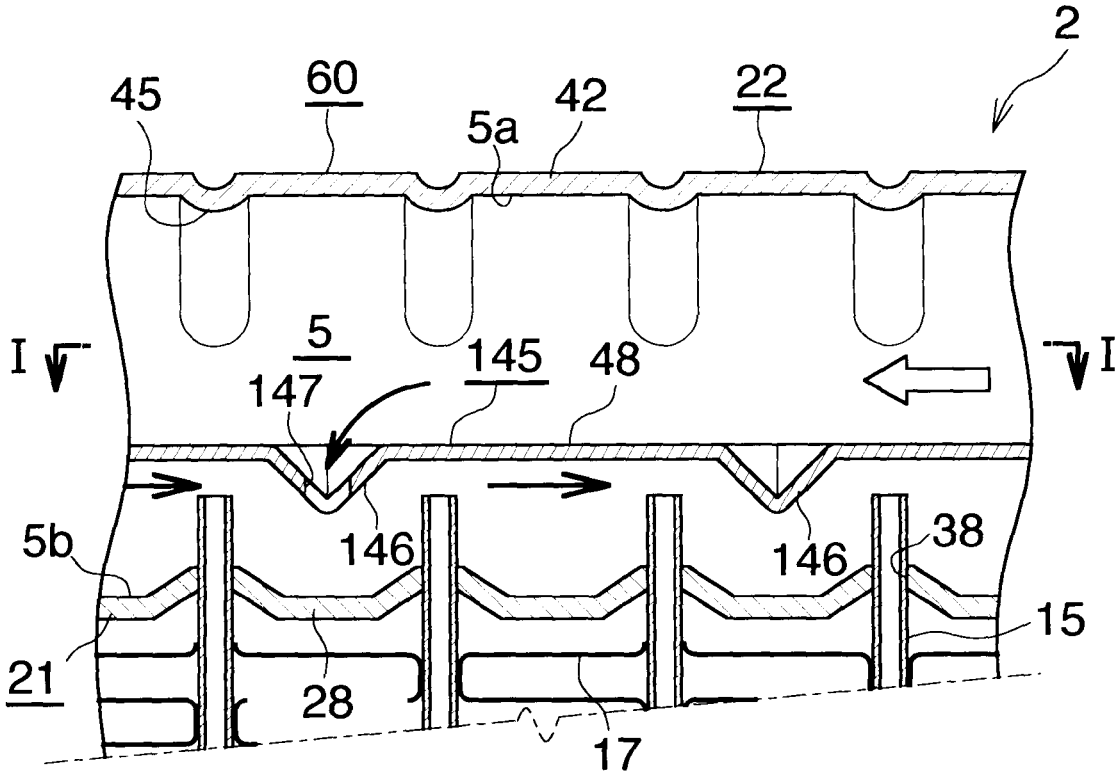
FIG. 16 is a view corresponding to the main portion of FIG. 6 and showing a fourth modification of the partition plate.
Figure 17:
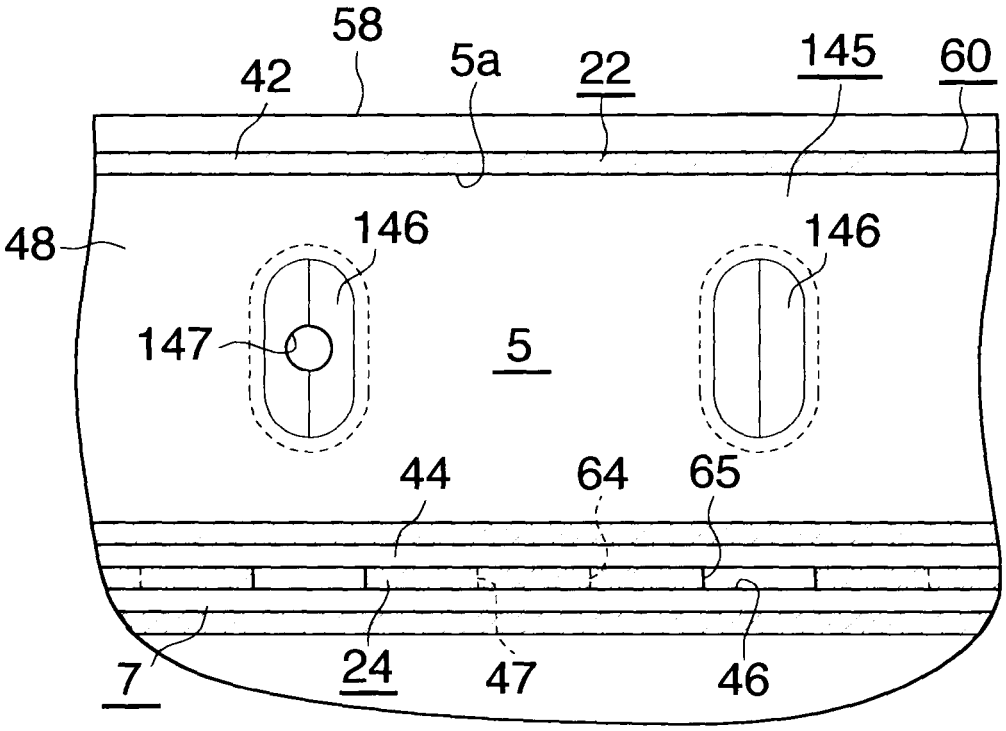
FIG. 17 is a cross sectional view taken along line I-I of FIG. 16.

In the case of a partition plate (145) used in the refrigerant inlet/outlet header tank (2) shown in FIGS. 16 and 17, on the front partition portion (48), which divides the interior of the refrigerant inlet header section (5) into the upper and lower spaces (5*a*) and (5*b*), projecting portions (146) each having a V-shaped transverse cross section are integrally formed at predetermined intervals in the left-right direction such that projecting portions (146) project downward (toward the heat exchange tubes (15)), and extend in the front-rear direction (the width direction of the refrigerant inlet/outlet header tank (2)). Of all the projecting portions (146), those at proper locations have refrigerant-passage through holes (147) formed to extend over opposite wall portions of the projecting portions (146), which wall portions form the V shape. Each projecting portion (146) is formed between two adjacent heat exchange tubes (15). The other structural features are identical with those of the partition plate (23) of the above-described embodiment.

Notably, although not illustrated in the drawings, the partition plate (145) may be used in the refrigerant turn tank (3). In this case, on the rear partition portion (49), which divides the interior of the second intermediate header section (12) into the upper and lower spaces (12*a*) and (12*b*), projecting portions (146) each having a V-shaped transverse cross section are integrally formed at predetermined intervals in the left-right direction such that projecting portions (146) project upward (toward the heat exchange tubes (15)), and extend in the front-rear direction (the width direction of the refrigerant inlet/outlet header tank (2)). Of all the projecting portions (146), those at proper locations have refrigerant-passage through holes (147) formed to extend over opposite wall portions of the projecting portions (146), which wall portions form the V shape. Each projecting portion (146) is formed between two adjacent heat exchange tubes (15).

Figure 18:
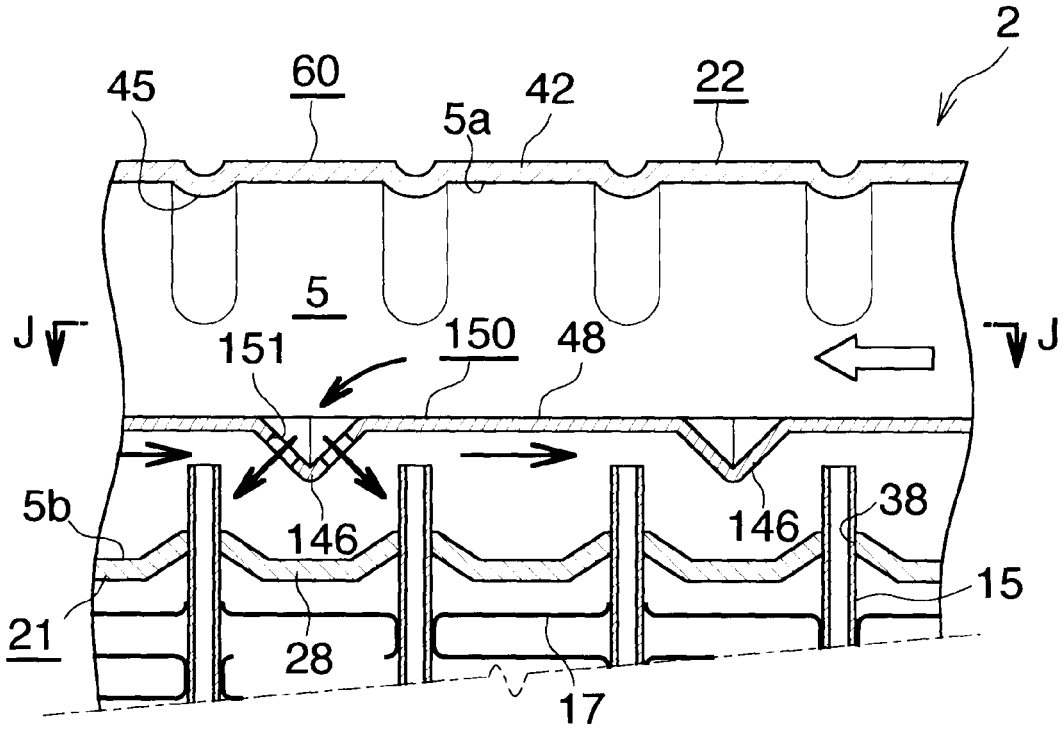
FIG. 18 is a view corresponding to the main portion of FIG. 6 and showing a fifth modification of the partition plate.
Figure 19:
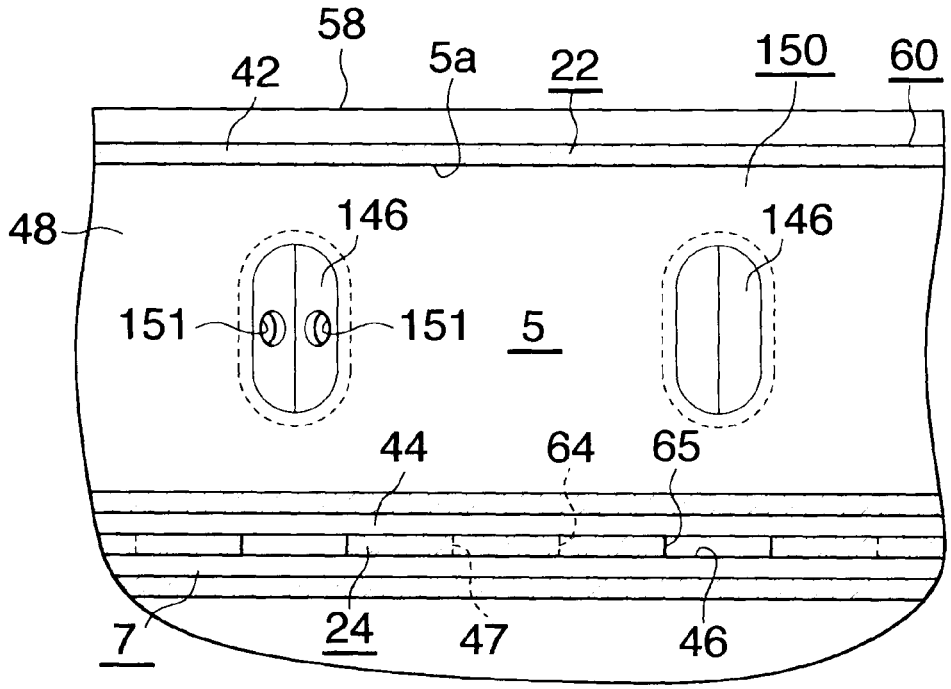
FIG. 19 is a cross sectional view taken along line J-J of FIG. 18.

In the case of a partition plate (150) used in the refrigerant inlet/outlet header tank (2) shown in FIGS. 18 and 19, of all the projecting portions (146) having a V-shaped transverse cross section, those at proper locations have refrigerant-passage through holes (151) formed in opposite wall portions of the projecting portions (146), which wall portions form the V-shape. Each projecting portion (146) is formed between two adjacent heat exchange tubes (15). The other structural features are identical with those of the partition plate (145) shown in FIGS. 16 and 17. Notably, the partition plate (150) shown in FIGS. 18 and 19 is also used in the refrigerant turn header tank (3) as in the case of the partition plate (145) shown FIGS. 16 and 17.

In the above-described embodiment, the heat exchanger of the present invention is applied to an evaporator of a car air conditioner using a chlorofluorocarbon-based refrigerant. However, the present invention is not limited thereto. The heat exchanger of the present invention may be used as an evaporator of a car air conditioner used in a vehicle, for example, an automobile, the car air conditioner including a compressor, a gas cooler (serving as a refrigerant cooler), an intermediate heat exchanger, an expansion valve, and an evaporator and using a supercritical refrigerant such as a $CO_2$ refrigerant.

What is claimed is:

1. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein a plurality of through holes are formed in a portion of the partition plate present within a header section in which refrigerant flows into the heat exchange tubes, wherein flanges are integrally formed on a surface of the partition plate facing the heat exchange tubes such that the flanges project toward the heat exchange tubes from circumferential edges of corresponding through holes to completely surround the corresponding through holes.

2. A heat exchanger according to claim 1, wherein each of the through holes is formed between adjacent heat exchange tubes.

3. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein a plurality of through holes are formed in a portion of the partition plate present within a header section in which refrigerant flows into the heat exchange tubes, wherein guide portions configured to guide refrigerant toward the heat exchange tubes from the space opposite the heat exchange tubes are integrally formed on one surface of the partition plate such that the guide portions project from circumferential edges of corresponding through holes.

4. A heat exchanger according to claim 3, wherein the guide portions are integrally formed on a surface of the partition plate facing the heat exchange tubes such that the guide portions project from portions of circumferential edges of the corresponding through holes, the portions being located on upstream sides of the through holes with respect to a flow direction of refrigerant within a space, opposite the heat exchange tubes, of the header section in which refrigerant flows into the heat exchange tubes.

5. A heat exchanger according to claim 3, wherein each of the through holes is formed between adjacent heat exchange tubes.

6. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein a plurality of bulging portions are formed on a portion of the partition plate present within a header section in which refrigerant flows into the heat exchange tubes such that the bulging portions project toward the heat exchange tubes and each have a flat projecting end wall; and at least one bulging portion includes a through hole formed in the projecting end wall.

7. A heat exchanger according to claim 6, wherein each of the bulging portions is formed between adjacent heat exchange tubes.

8. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein hemispherical bulging portions are formed on a portion of the partition plate present within a header section in which refrigerant flows into the heat exchange tubes such that the bulging portions project toward the heat exchange tubes; and at least one bulging portion includes a plurality of through holes formed therein.

9. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein a plurality of projecting portions each having a V-shaped transverse cross section are formed on a portion of the partition plate present within a header section in which refrigerant flows into the heat exchange tubes such that the projecting portions project toward the heat exchange tubes and extend in a width direction of the header tank; and a through hole is formed in at least one projecting portion such that the through hole extends over opposite wall portions of the projecting portion, which wall portions form the V shape.

10. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein a plurality of projecting portions each having a V-shaped transverse cross section are formed on a portion of the partition plate present within a header section in which refrigerant flows into the heat exchange tubes such that the projecting portions project toward the heat exchange tubes and extend in a width direction of the header tank; and a through hole is formed in each of opposite wall portions of at least one projecting portion, which wall portions form the V shape.

11. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces, and the partition plate includes through holes that establish communication between the upper and lower spaces of each header section, wherein the partition plate has grooves formed along opposite side edges portions of the partition plate such that the grooves extend along the longitudinal direction and are opened toward a direction opposite the heat exchange tubes; and opposite side edge portions of the second member are fitted into the grooves.

12. A heat exchanger comprising:

upper and lower header tanks separated from each other in a vertical direction; and a plurality of heat exchange tube groups positioned in a front-rear direction between the header tanks, each heat exchange tube group comprising a plurality of heat exchange tubes which are positioned at predetermined intervals along a longitudinal direction of the header tanks and whose opposite end portions are connected to corresponding header tanks, and each of the header tanks including two header sections positioned in the front-rear direction and integrated together, wherein each of header tanks comprises a first member to which the heat exchange tubes are connected and a second member which is joined to the first member and covers a side of the first member opposite the heat exchange tubes, and at least one heat exchange tube group is provided between each header section of the upper header tank and a corresponding header section of the lower header tank, wherein the first and second members of each header tank are joined via a partition plate which divides the two header sections into respective upper and lower spaces; and the partition plate includes through holes that establish communication between the upper and lower spaces of each header section, wherein the front header section of one header tank serves as a refrigerant inlet header section, the rear header section of the one header tank serves as a refrigerant outlet header section, the front header section of the other header tank serves as a first intermediate header section, and the rear header section of the other header tank serves as a second intermediate header section; a refrigerant inlet is formed in one end portion of the refrigerant inlet header section, and a refrigerant outlet is formed in one end portion of the refrigerant outlet header section located on a same side as the end portion of the refrigerant inlet header section; and each of the refrigerant inlet header section and the second intermediate header section serves as a header section in which refrigerant flows into the heat exchange tubes, wherein a communication hole is formed in an end portion of the partition plate opposite the refrigerant inlet and the refrigerant outlet to establish communication between the two spaces of the refrigerant inlet header section; and a communication portion is provided at one longitudinal end of the header tank to establish communication between an outer space of the first intermediate header section with respect to the vertical direction and an outer space of the second intermediate header section with respect to the vertical direction.

* * * * *